US006226929B1

(12) United States Patent
Gagas

(10) Patent No.: US 6,226,929 B1
(45) Date of Patent: May 8, 2001

(54) LIQUID INFILTRATION PREVENTION STRUCTURES FOR PREVENTING LIQUID INFILTRATION MANHOLE ASSEMBLIES GATE VALUE SEALING STRUCTURES FOR PREVENTING SETTLING OR SHIFTING OF KEY BOX BONNETS AND METHOD FOR USING SAID STRUCTURES

(76) Inventor: Michael Gagas, 4867 N. Anita Ave., Whitefish Bay, WI (US) 53217

( * ) Notice: Subject to any disclaimer, the term of this patent is extended or adjusted under 35 U.S.C. 154(b) by 0 days.

(21) Appl. No.: 09/456,611

(22) Filed: Dec. 8, 1999

Related U.S. Application Data

(62) Division of application No. 08/743,465, filed on Oct. 30, 1996, now Pat. No. 6,044,590.
(60) Provisional application No. 60/008,155, filed on Oct. 31, 1995.

(51) Int. Cl.[7] ..... E02D 29/12
(52) U.S. Cl. ..... 52/20; 137/367; 404/25
(58) Field of Search ..... 52/20; 137/367; 251/292; 404/25

(56) References Cited

U.S. PATENT DOCUMENTS

| | | | | |
|---|---|---|---|---|
| Re. 29,532 | | 2/1978 | Zwick . | |
| 349,597 | | 9/1886 | Clarke . | |
| 514,633 | | 2/1894 | Sund . | |
| 536,268 | | 3/1895 | Cullen . | |
| 589,357 | | 8/1897 | Link . | |
| 604,622 | | 5/1898 | Lobdell et al. . | |
| 820,616 | | 5/1906 | Batt . | |
| 852,359 | | 4/1907 | Walcott et al. . | |
| 996,956 | | 7/1911 | Walcott . | |
| 1,608,772 | | 11/1926 | Cole . | |
| 1,987,502 | | 1/1935 | Born et al. . | |
| 2,008,138 | | 4/1935 | Le Due . | |
| 2,099,479 | | 11/1937 | Heinkel . | |
| 2,596,532 | * | 5/1952 | Coolidge et al. | 137/139 |
| 3,308,727 | | 3/1967 | Hurt, Jr. . | |
| 3,548,864 | | 12/1970 | Handley . | |
| 3,658,086 | | 4/1972 | Hart . | |
| 4,029,425 | | 6/1977 | Pelsue . | |
| 4,030,519 | | 6/1977 | Zinn . | |
| 4,275,757 | * | 6/1981 | Singer | 137/363 |
| 4,305,679 | | 12/1981 | Modi . | |
| 4,308,886 | | 1/1982 | Handley et al. . | |
| 4,350,177 | | 9/1982 | Firchau et al. . | |
| 4,368,893 | | 1/1983 | Gagas . | |
| 4,440,407 | | 4/1984 | Gagas . | |
| 4,449,715 | | 5/1984 | Gagas . | |
| 4,469,467 | | 9/1984 | Odill et al. . | |
| 4,475,845 | | 10/1984 | Odill et al. . | |
| 4,534,378 | * | 8/1985 | Gagas et al. | 137/367 |
| 4,556,081 | | 12/1985 | Gagas . | |
| 4,772,154 | | 9/1988 | Caroulle . | |
| 4,819,687 | * | 4/1989 | Alberico et al. | 137/367 |
| 4,872,780 | * | 10/1989 | Bowman | 404/26 |
| 4,927,163 | | 5/1990 | Gagas . | |

(List continued on next page.)

FOREIGN PATENT DOCUMENTS 2102479 2/1983 (GB) .

*Primary Examiner*—Christopher T. Kent
(74) *Attorney, Agent, or Firm*—Ryan Kromholz & Manion, S.C.

(57) ABSTRACT

A gate valve box adaptor structure, the present invention provides a permanent support for the key box bonnet that is unaffected by the surrounding environment. The adaptor is supported on the gate valve to a positive location for the key box bonnet at a level which prevents infiltration of soil and moisture into the bonnet. The adaptor is provided with a resilient gasket of a unique design to provide a cushion and to create a seal for the bonnet on the gate valve.

A plurality of liquid infiltration prevention structures for preventing liquid infiltration into manhole assemblies.

11 Claims, 33 Drawing Sheets

U.S. PATENT DOCUMENTS

| | | | | |
|---|---|---|---|---|
| 5,095,667 | | 3/1992 | Ryan et al. . | |
| 5,201,151 | * | 4/1993 | LeBlanc et al. | 52/20 |
| 5,240,345 | | 8/1993 | Gagas . | |
| 5,299,884 | | 4/1994 | Westhoff et al. . | |
| 5,316,040 | | 5/1994 | Townsend et al. . | |
| 5,628,152 | * | 5/1997 | Bowman | 52/20 |

* cited by examiner

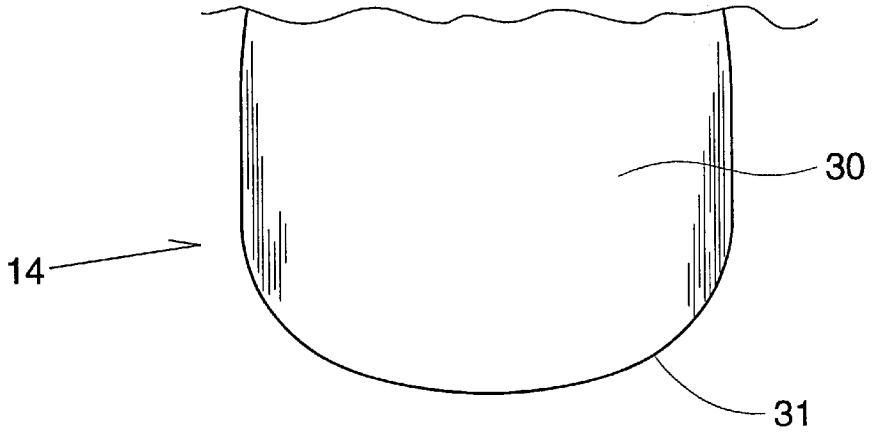
Fig. 1c
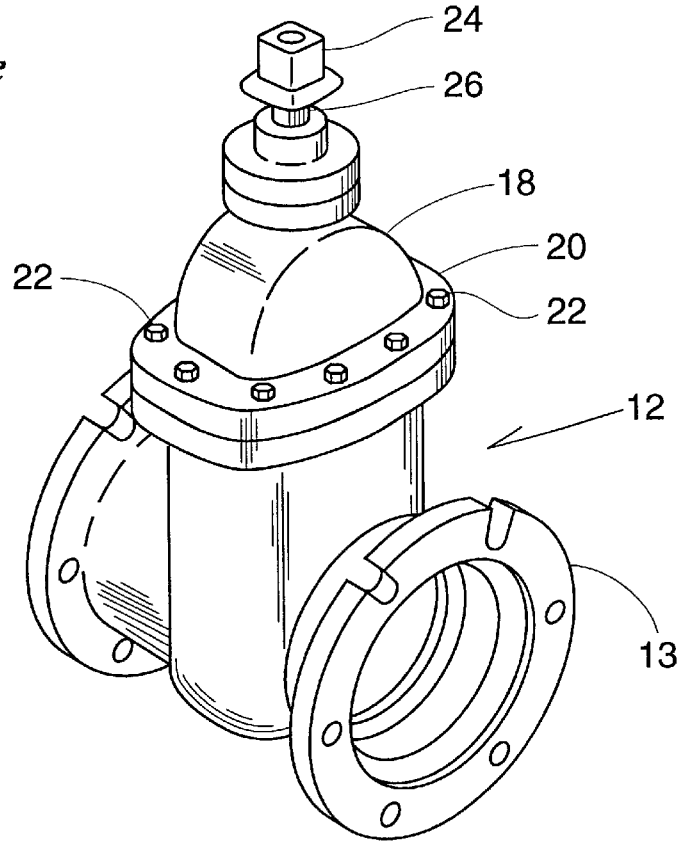

LIQUID INFILTRATION PREVENTION STRUCTURES FOR PREVENTING LIQUID INFILTRATION MANHOLE ASSEMBLIES GATE VALUE SEALING STRUCTURES FOR PREVENTING SETTLING OR SHIFTING OF KEY BOX BONNETS AND METHOD FOR USING SAID STRUCTURES

This application is a divisional application of application Ser. No. 08/743,465, filed Oct. 30, 1996, for Liquid Infiltration Prevention Structures for Preventing Liquid Infiltration Manhole Assembles, now U.S. Pat. No. 6,044,590.

Priority and benefit of earlier filing date of provisional application Ser. No. 60/008,155 filed Oct. 31, 1995 is claimed.

BACKGROUND OF THE INVENTION

The present invention relates generally to the field of manhole and gate valve construction and specifically to structures that effectively prevent or substantially limit infiltration of liquid, water, into the manhole or gate valve area. In particular, the structures of the present invention relate to sealing against the surfaces of a manhole or gate valve through which water infiltration between the manhole casting or portions thereof or portions of the gate valve structure may occur. Additionally, the present invention relates to structures which prevent water seepage through the supporting structure of a manhole or gate valve structure and problems related to ground settling or filling in around the gate valve structure.

In conventional manhole assembly or gate valve assembly a manhole casting, which is the uppermost portion of the assembly and serves as the seat of the manhole cover, rests or is fastened to a supporting structure. The supporting structure may be a manhole cone or there may be one or more adjusting rings between the cone and casting. Sometimes the combination of the cone and castings are referred to as the cone. This is just a shorthand for referring to the supporting structure. When the adjusting rings are used the portion of the structure intermediate the casting and the cone is typically called a manhole chimney. The interface between the casting and cone or adjusting ring on which it rests consists generally of two opposing flat surfaces.

Manhole chimneys have normally been constructed with pre-cast rings or with brick or block and have been used on manhole cones constructed from pre-cast sections or of brick or block or cast in place of concrete. Existing manhole assemblies may also have had castings shimed with wood or bricks and mortar placed in the gaps between the shims.

Unfortunately, conventional manhole assemblies can allow for infiltration of surface water into the manhole at the interfaces or locations where the casting and the cone meet or between the casting and the adjusting rings, or between the adjusting rings.

Consequently, as the manhole assembly ages the problem of water infiltration becomes more severe due to the deterioration of the supporting structure.

This deterioration is due in part, to the movement and setting of the earth and also due to the freeze/thaw cycle common to much of the United States during the winter and spring. This causes a breakdown in the interfaces in the manhole assembly. The expansion/contraction causes cracking and gaps form. Surface water easily infiltrates between the gaps resulting from the deteriorated interfaces.

Additionally, the vibration of passing traffic striking the manhole can also lead to deterioration. Manhole assemblies are commonly located beneath the surface of a road, with the manhole cover and top portion of the casting being flush with the road surface. The weight of vehicles passing over the assembly commonly causes interfaces to deteriorate and also creates cracks in the road surface surrounding the manhole assembly. This can allow surface water to run through these cracks and infiltrate the deteriorated structure.

These factors can also cause a vertical or horizontal displacement of the casting relative to the supporting structure which further increases the probability of water infiltration. Water or liquid infiltration into the sewer collection system represents a major problem in sewage treatment. The capacity of a sewage treatment system in large part is a measure of the volume of the effluent it can treat. Water infiltration during rain storms or during periods of extended rainfall activity adds to the total volume of effluent treated. This increased volume of flow may overload new or old sewage treatment systems. In most cases, the excess volume of the effluent overload is dumped untreated in rivers and lakes.

This is not acceptable. It is believe that water infiltration through manhole assemblies is one of the primary contributions to the overloading of sewage treatment systems.

Another problem which results from surface water infiltration of manhole assemblies is the broad dissemination of contaminated surface water, especially when the contaminate is a petrochemical or dangerous pollutant. Contaminated surface water which infiltrates the sewage system through a manhole will be distributed to other cites by the sewage lines or water runoff lines to which the manhole assemblies are connected. Thus, a contaminate that should be contained and disposed of safely away from population centers is instead widely dispersed in an uncontrolled fashion.

Accordingly, it is desired to prevent not only liquid infiltration into a sewer system but the infiltration of liquids which have been properly been deposited into the sewer system from leaving the sewer system or leaching into the surrounding ground. Consequently, there is a continuing need in the field of the present invention for an apparatus to seal the assembly against surface water infiltration. There is also a need for a seal to be effective against infiltration occurring in the area between the casting and the supporting structure and through the supporting structure. There is also a need for a seal that can accommodate vertical and horizontal displacement of the casting relative to the supporting structure during prolonged use. There is also a need for the seal to be economically manufactured and simply constructed so that it may easily be applied in the field. This also a need for a seal that does not interfere with normal use of the manhole.

Additionally, there is a need for seals for use in conjunction with gate valve adapters. Gate valves are used to control the flow of water and other fluids through underground piping. These valves are buried in the ground. In order to operate the valves, a key is used to turn the operating nut of the valve. The valve is mounted on the end of a long rod in order to reach the operating nut on the valve. Access to the operating nut is generally provided through a key box having a bonnet that is placed over the gate valve to prevent the operating nut from being buried in the ground. The bonnet is generally supported on wood blocks located on each side of the gate valve. As a result of settling of the ground or deterioration of the block the key box bonnet often shifts with respect to the gate valve allowing the ground to enter the bonnet and make it difficult to operate the operating nut. Accordingly, the key box may not operate or may not allow proper setting of the gate valve. This creates problems associated with backfilling, settling, shifting, or an improper setting of the key box over the valve. The present seal structure of the present invention disclosed herein is design to prevent liquid infiltration and inadvertent settling or shifting of a gate valve box. Accordingly the present invention eliminates the usual problems associated with backfilling, settling, shifting or improper setting of the key box over the valve and ensures a perfect setting of the key box on the gate valve.

SUMMARY OF THE INVENTION

A gate valve box adaptor structure, the present invention provides a permanent support for the key box bonnet that is unaffected by the surrounding environment. The adaptor is supported on the gate valve to a positive location for the key box bonnet at a level which prevents infiltration of soil and moisture into the bonnet. The adaptor is provided with a resilient gasket of a unique design to provide a cushion and to create a seal for the bonnet on the gate valve.

A plurality of liquid infiltration prevention structures for preventing liquid infiltration into manhole assemblies.

DESCRIPTION OF THE DRAWINGS

FIG. 1C is a perspective view showing the relationship between a standard gate valve and a key box bonnet.

FIG. 48 discloses an internal sealing structure which is yet another alternative embodiment of the sealing structure disclosed in the present invention.

DETAILED DESCRIPTION

Figure 1A:
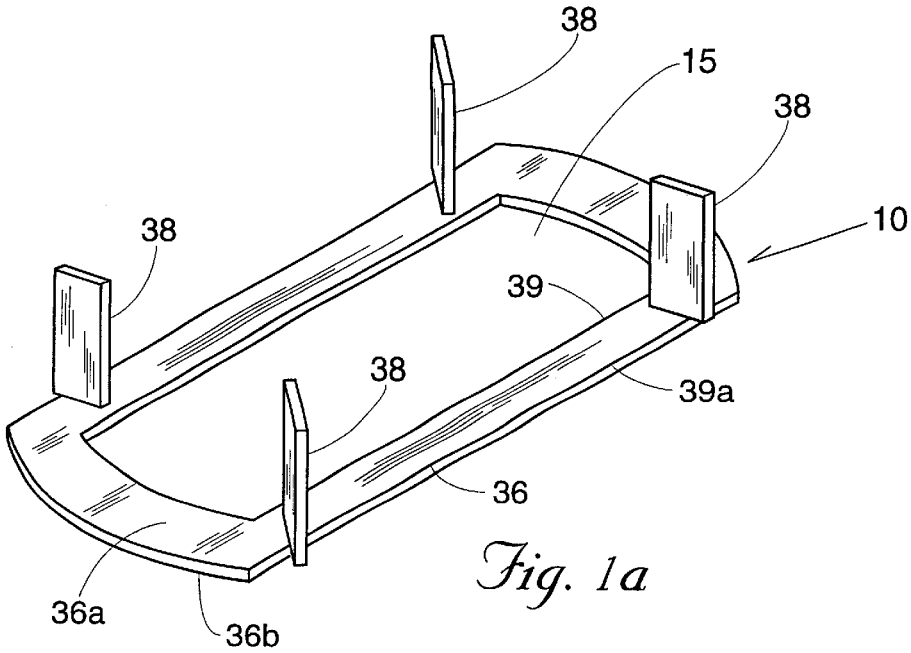
FIG. 1A is a perspective view of an embodiment of the gate valve seal structure of the present invention.
Figure 1B:
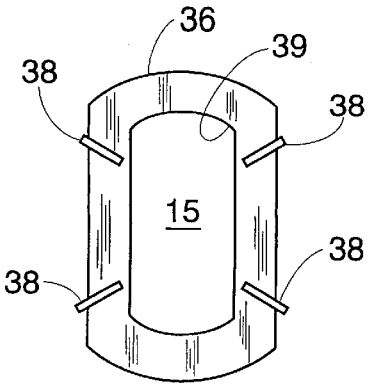
FIG. 1B is a top plan view of the gate valve seal structure of FIG. 1A.

Although the disclosure hereof is detailed and exact to enable those skilled in the art to practice the invention, the physical embodiments herein disclosed merely exemplify the invention which may be embodied in other specific structure. While the preferred embodiment has been described, the details may be changed without departing from the invention, which is defined by the claims.

Referring to the Figures it should be noted that FIGS. 1–14, 32–39, and 41–44, 58, 58A disclose various gate valve adapting structures while FIGS. 15–31 and 48–57A, 59–61A disclose various liquid infiltration prevention structures for preventing liquid infiltration into manhole assemblies. Accordingly, each group of Figures will be discussed in turn. Further, all structures disclosed herein are typically made from an elastomeric material such as rubber or plastic but any suitable elastomeric material may be used. Additionally, nonelastomeric materials such as rigid plastic, steel, wood, or concrete may be used but it is considered best if such materials are coated with an elastomeric material or used in conjunction with an elastomeric material in order to achieve maximum resistance to water and dirt infiltration.

Referring to FIGS. 1–14, 35–39, and 41–44 various embodiments of the gate vale adapting structures 10 may be seen. With particular reference to FIG. 1C and FIGS. 1–14 the gate valve box adapting structures 10 may be seen to be used in conjunction with a gate valve 12. The gate valve box adapting structures 10 are used to support a key box 14 on the valve 12. The gate valve 12 is a standard type gate valve which is used to control the flow of water through a water main 13. The gate valve 12 includes a bonnet 18 having a flange 20 secured to the valve 12 by a number of bolts 22. The gate valve 12 is controlled by means of an operating nut 24 mounted on the upper end of a stem 26. Gate valves 12 of this type are buried beneath the normal frost line for the part of the country or world in which the gate valve is located.

Access to the operating nut 24 is provided through a key box 14 which includes a box bonnet 30, a threaded tubular head, and a cap or cover 34 provided at the top of the head. The bonnet 30 is designed to enclose the top of the gate valve bonnet in order to protect the operating nut. The heads can be raised or lowered to ground level to provide access to the operating nut. The gate valve can then be turned on or off by inserting a key (not shown) through the key box to engage the operating nut 24.

When the bonnet 30 is allowed to rest only on ground surrounding the gate valve 12 it can settle down onto the nut and thereby make it impossible to open the gate valve 12 without major effort. Additionally, infiltration of dirt into the bonnet 30 may cover up the nut and thus again make it impossible to manipulate without additional effort.

Referring to FIGS. 1–14, excluding FIG. 1C, various effective gate valve box adapting structures 10 and their components may be seen. In particular, looking at FIGS. 1A, 1B, 2, and 3, the general structure of the gate vale box adaptor 10 may be seen to be a ring 36 having a substantially central opening 15, a top side 36*a*, a bottom side 36*b*, an inner margin surface 39, and an outer margin surface 39*a*. The ring 36 further includes bonnet positioning structures or legs 38 positioned roughly equidistant from each other on the top surface 36*a* of the ring 36. The ring 36 may be of any shape such that it provides a surface, e.g., like top surface 36*a*, with which the bottom 31 of the bonnet 30 may engage or to which legs 38 may be mounted.

Figure 2:
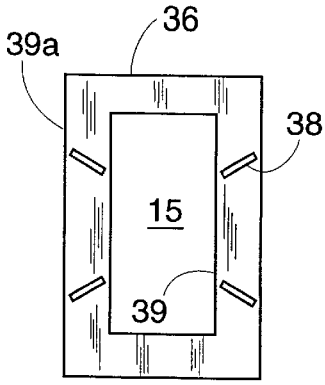
FIG. 2 is a top plan view of an alternative embodiment of the gate valve seal structure.
Figure 3:
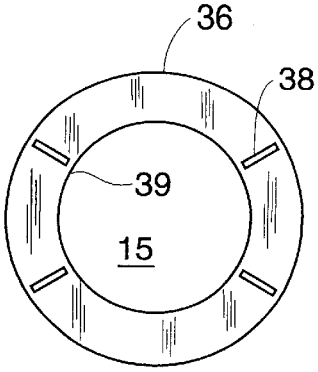
FIG. 3 is an alternative embodiment of the gate valve seal structure.
Figure 4:
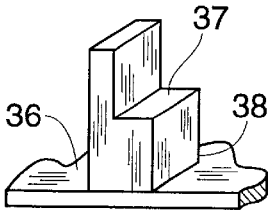
FIG. 4 is cross sectional view of a portion of the gate valve seal structure showing the form of the leg of the gate valve seal structure.
Figure 5:
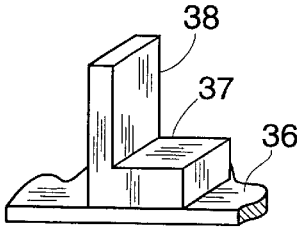
FIG. 5 is an alternative cross sectional perspective view of an alternative leg design.
Figure 6:
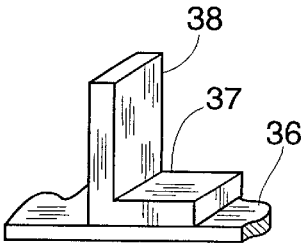
FIG. 6 is a cross sectional perspective view of another alternative leg design.

Referring now to FIGS. 1–14 it may be seen that legs 38 may be positioned in various ways upon the ring 36. For example, legs 38 may be positioned upon the ring 36 so that a portion of each leg 38 extends out past margin 39*a* so that margin surface 39 of top surface 36*a* is capable of engaging the bottom 31 of the bonnet 30. Alternatively, the legs 38 may be positioned so that both margin surfaces 39 and 39*a* of top surface 36*a* are capable of engagement with the bottom rim 31 of the bonnet 30 as shown in FIGS. 2 and 3.

Figure 7:
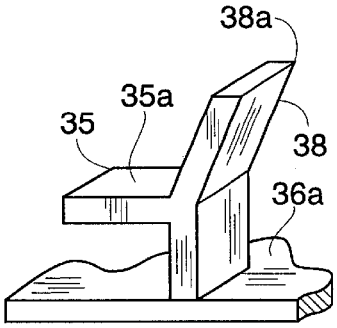
FIG. 7 is a cross sectional perspective view of another alternative leg design.
Figure 8:
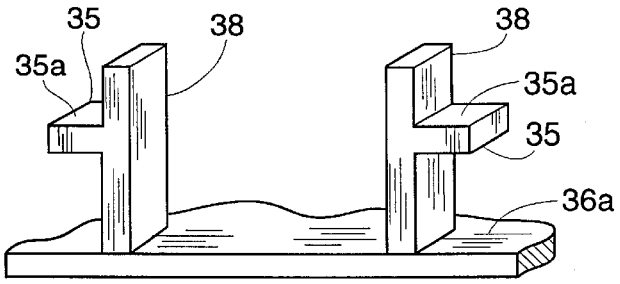
FIG. 8 is a cross sectional perspective view of another alternative leg design.
Figure 9:
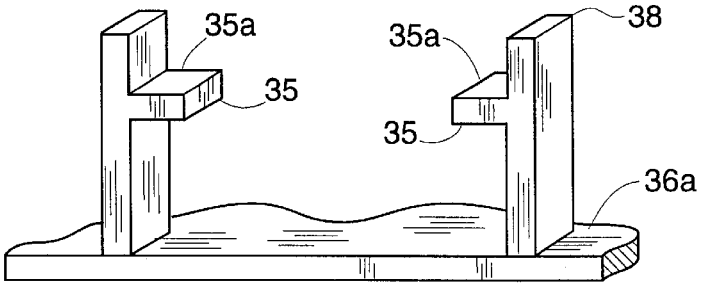
FIG. 9 is a cross sectional perspective view of another alternative leg design.
Figure 10:
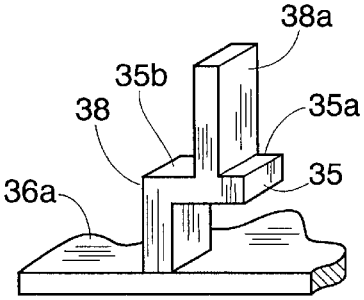
FIG. 10 is a cross sectional perspective view of another alternative leg design.
Figure 11:
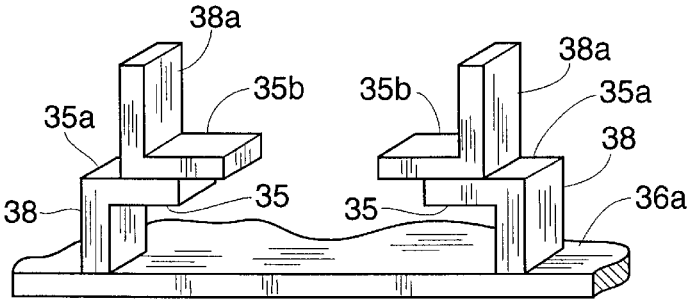
FIG. 11 is a cross sectional perspective view of another alternative leg design.
Figure 12:
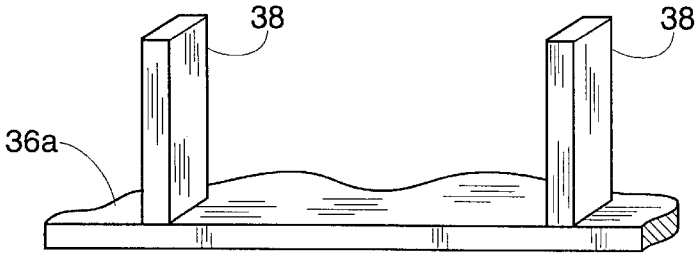
FIG. 12 is a cross sectional perspective view of another alternative leg design.
Figure 13:
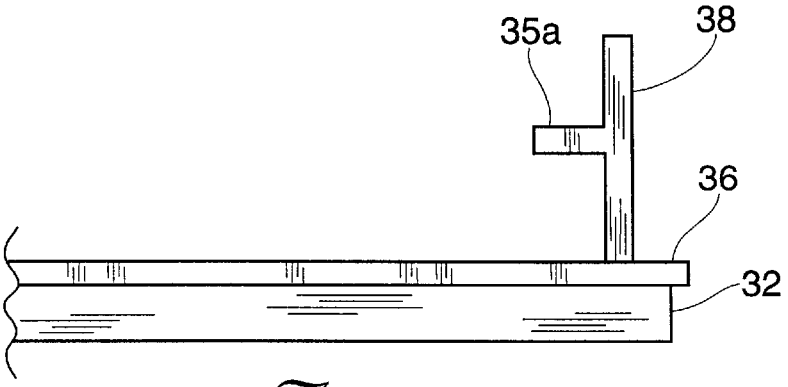
FIG. 13 is yet another alternative embodiment of the proposed gate valve design showing a cross sectional view of the gate valve seal and the leg structure.
Figure 14:
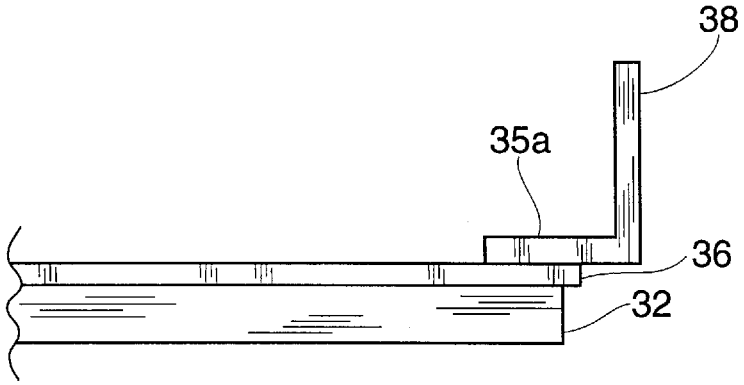
FIG. 14 is another cross sectional view of an alternative embodiment of the present invention showing an alterative gate valve seal structure.

Additionally, the legs 38 may be modified to include a step 37 that could act to engage the bottom rim 31 of the bonnet 30. See for example FIGS. 4–6. Further, the legs 38 could be of substantially any design depending upon the characteristics of the gate valve 12. Referring to FIGS. 7–12 a variety of alternative leg structures may be viewed. FIG. 7 shows a leg 38 having an extension 35 including a top surface 35*a*. A portion 38*a* of the leg 38 extending above top surface 35*a* and away from top surface 35*a* such that an obtuse angle between top surface 35*a* and portion 38*a* of leg 38 is formed. FIGS. 8 and 9 illustrate that the legs may be arranged in any manner suitable for the type of bonnet 30 that is to be engaged. The extensions 35 may extend either toward or away from the opening 15 of the ring 36. FIG. 10 illustrates a compound leg 38 extending from the top surface 36*a* of the ring 36. The compound leg 38 again includes the extension 35 but the top surface of the extension 35 is divided by an extension 38*a* so that the top surface of the extension 35 is divided into sections 35*a* and 35*b*. Consequently the bottom 31 of the bonnet 30 could engage surfaces 36*a*, 35*b*, or 35*a*. FIG. 11 illustrates another alternative compound leg 38. In this embodiment top surface 35*a* of extension 35 has an alternative L-shaped extension 38*c* mounted to it. L-shaped extension 38*c* has a surface section 35*b*. Consequently, the bottom 31 of the bonnet 30 can engage surfaces 35*b*, 35*a*, or 36*a* in this embodiment. FIG. 12 illustrates the legs 38 extending from the top surface 36*a* without any compound features. FIGS. 13 and 14 show alternative designs of leg 38 positioned on ring 36. In fact, the designs shown in FIGS. 13 and 14 of leg 38 are presently considered to be the commercially preferred designs because of ease of installation of the bonnet 30 onto the gate valve 12. Additionally and preferably a gasket flange 32, which may be positioned on the underside of the ring 36, may be included as part of the ring 36. The gasket flange 32 extending down and away from the underside of the ring 36.

Figure 32:
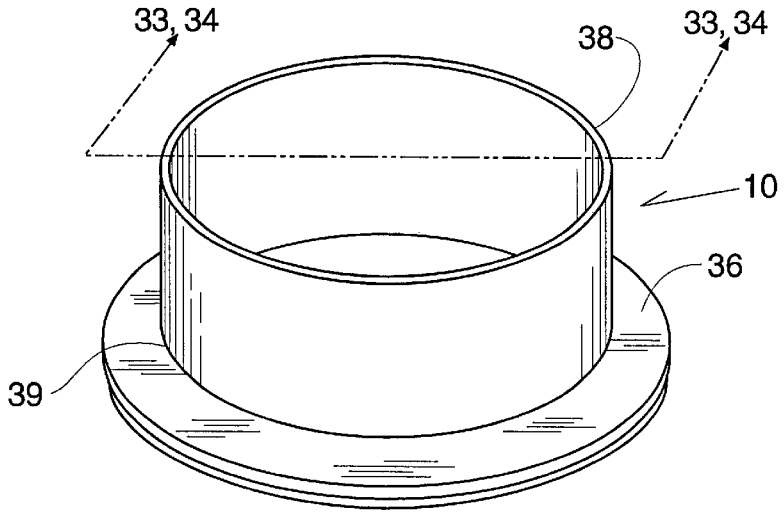
FIG. 32 discloses a perspective view of an alternative embodiment of the internal gate valve seal.

Referring now to FIGS. 32–39 another series of alternative structures for the gate valve seal 10 may be seen. Referring to FIG. 32 the alternative gate valve seal 10 may be seen to include the ring 36 but the extension 38 is now a continuous donut shaped ring integrally connected to the ring 36 at the inter margin 39. Again it should be noted that while a ring structure is specifically disclosed that other ring shapes including rectangles and triangles could be used depending upon the structure of the bonnet 30 that is to be engaged or the requirements of the particular job.

Figure 33:
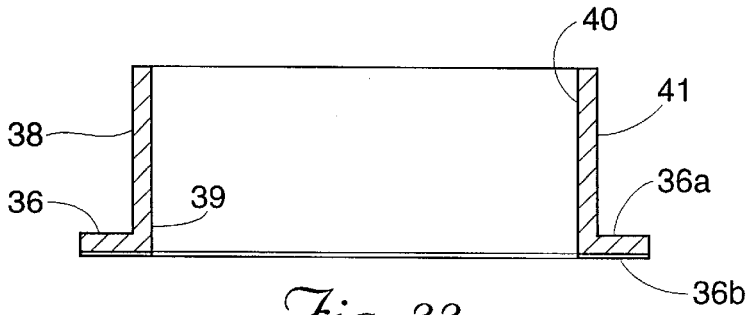
FIG. 33 shows a cross sectional view of the internal gate valve seal disclosed in FIG. 32.
Figure 34:
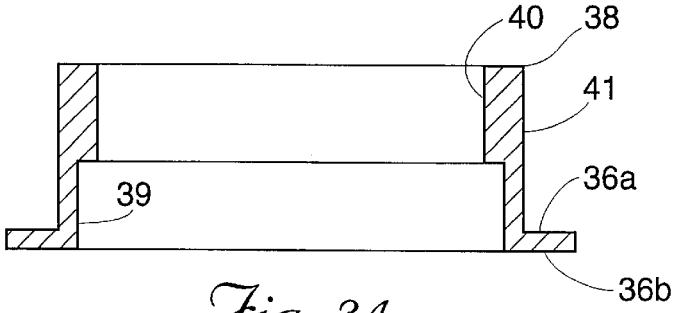
FIG. 34 discloses a cross sectional view of an alternative embodiment of the internal gate valve seal disclosed in FIG. 32.

Referring to FIG. 33 a cross-sectional side view of the gate valve seal 10 may be seen. As illustrated, extension 38 has a continuous outer surface 41 and a continuous inner surface 40. Extension 38 and ring 36 are integral to each other at margin 39. Alternatively, referring to FIG. 34, the inner surface 40 of extension 38 may be stepped to provide additional surface area for contacting the structure of the gate valve 12.

Figure 35:
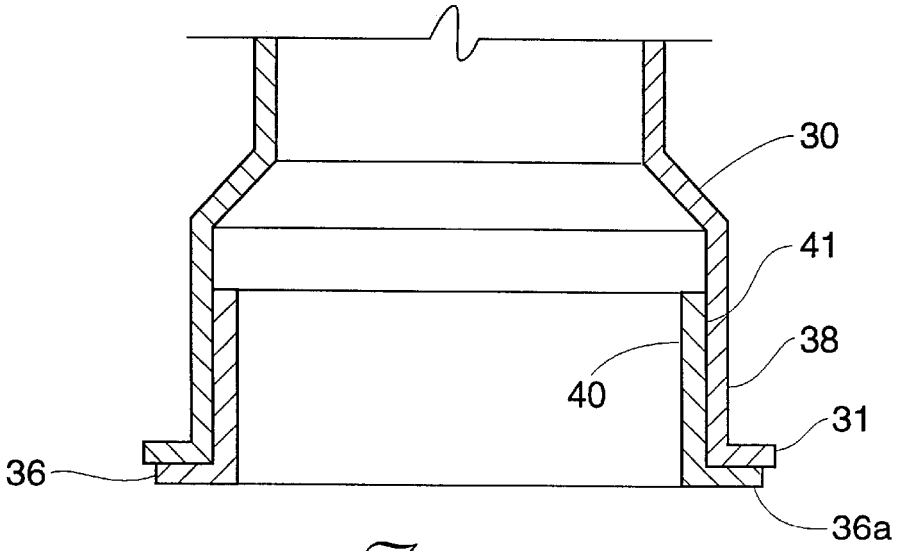
FIG. 35 discloses a cross sectional view of the internal gate valve seal used in conjunction with a gate bonnet.

Referring to FIG. 35 another alternative to the gate valve seal 10 disclosed in FIGS. 32 and 33 is disclosed. Inner surface 40 of the extension 38 is provided with a slope. Again this is to facilitate engagement of inner surface 40 with portions of the gate valve 12 to add in prevention of liquid or dirt infiltration as well as to provide added stability so that the bonnet 30 is not easily displaced from proper position on the gate valve 12.

Figure 36:
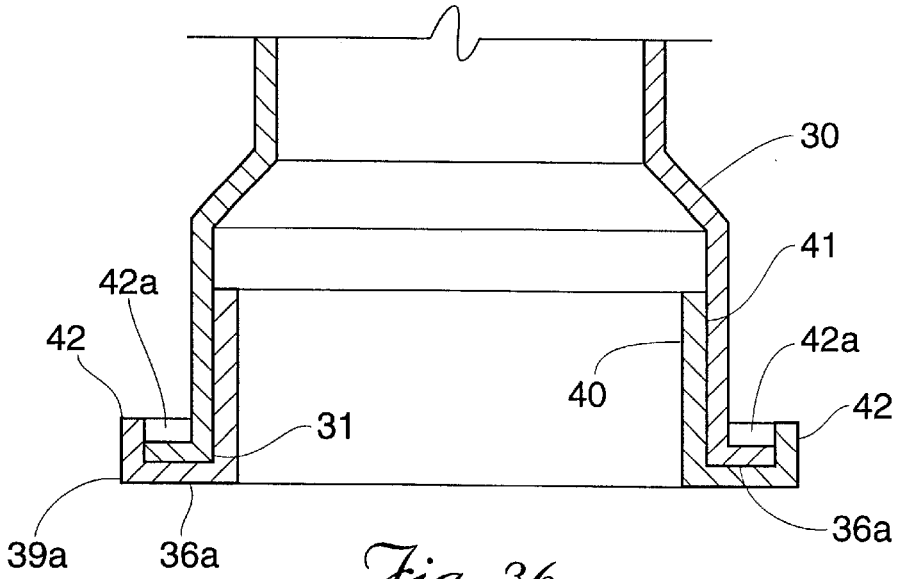
FIG. 36 discloses a cross sectional view of an alternative embodiment of the internal gate valve seal used in conjunction with the bonnet.
Figure 37:
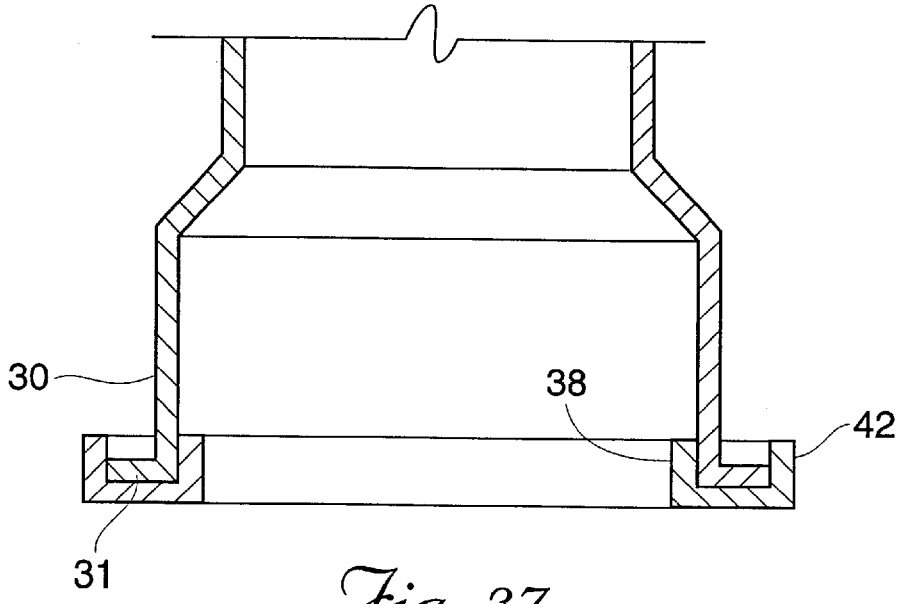
FIG. 37 discloses a cross sectional view of another alternative embodiment of the valve seal in conjunction with the bonnet.
Figure 38:
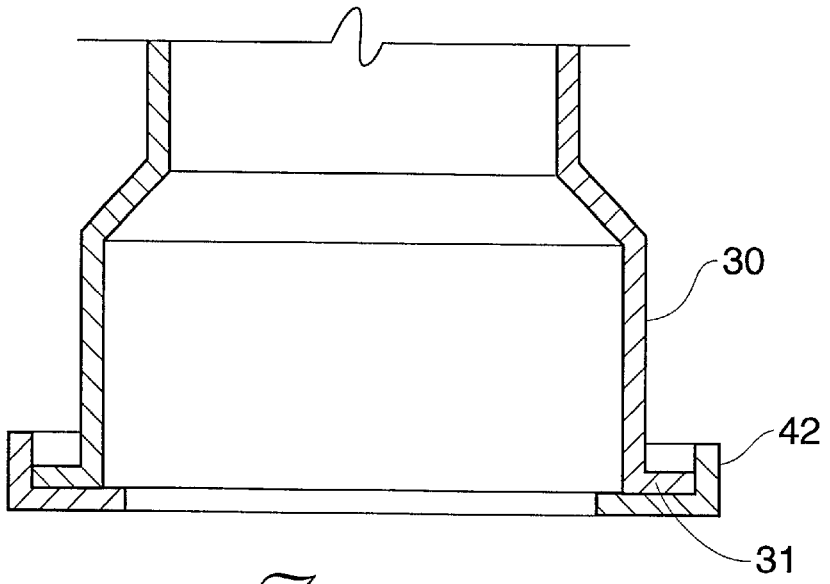
FIG. 38 discloses a cross sectional view of another alternative embodiment of the gate valve seal used in conjunction with the bonnet.

Referring to FIG. 36 another alternative embodiment of the gate valve seal 10 may be seen. In this embodiment a flange extension 42 integral to margin 39*a* is provided. As may be seen in FIG. 36 flange extension 42 extends upward away from top surface 36*a*. Consequently a channel 42*a* is formed between flange extension 42 and extension 38. Channel 42*a* is capable of receiving bottom 31 of the bonnet 30. Channel 42*a* provides yet another way to positively engage bottom 31 and properly secure bonnet 30 to prevent undesirable movement of the bonnet 30. Additionally, as shown in FIG. 37 extension 38 need not be longer than extension 42. Further, as shown in FIG. 38, extension 38 may be entirely eliminated so that only extension 42 is used to hold the bottom 31 of the bonnet 30 in its desired position.

Figure 39:
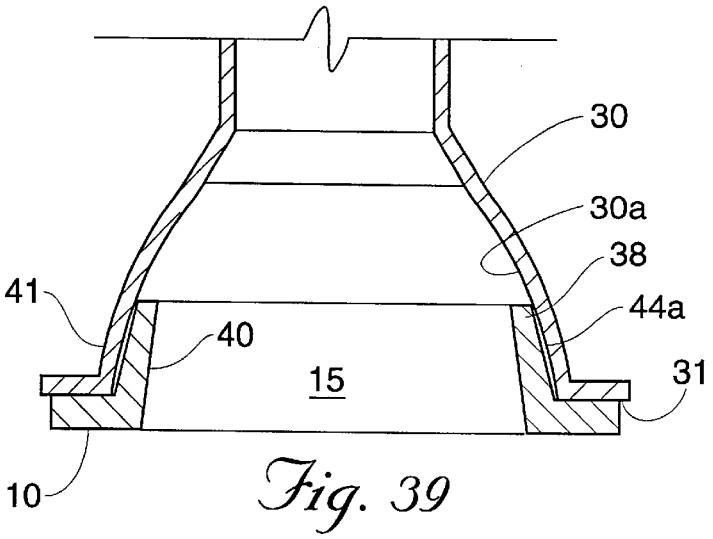
FIG. 39 discloses a cross sectional view of an internal gate valve seal alternative to those previously disclosed in conjunction with an alternative bonnet structure.

Referring now to FIG. 39 another possible alternative of the present invention may by seen. In this embodiment of the gate valve seal 10 the extension 38 is orientated to that its inner and outer surfaces 40 and 41 are sloped to accommodate a bonnet having a sloped wall 30*a* and to enhance positive engagement and sealing between surface 41 and wall 30*a*. Additionally, to further enhance the engagement between surface 41 and wall 30*a* a butyl rubber compound 44*a* is applied to surface 41 prior to placement of the bonnet 30 on the gate valve seal 12.

It should be noted that to enhance any point of engagement between any sealing structure disclosed herein and any gate valve or man hole structure that butyl rubber or an equivalent material capable of performing in a similar manner may be used.

Figure 41:
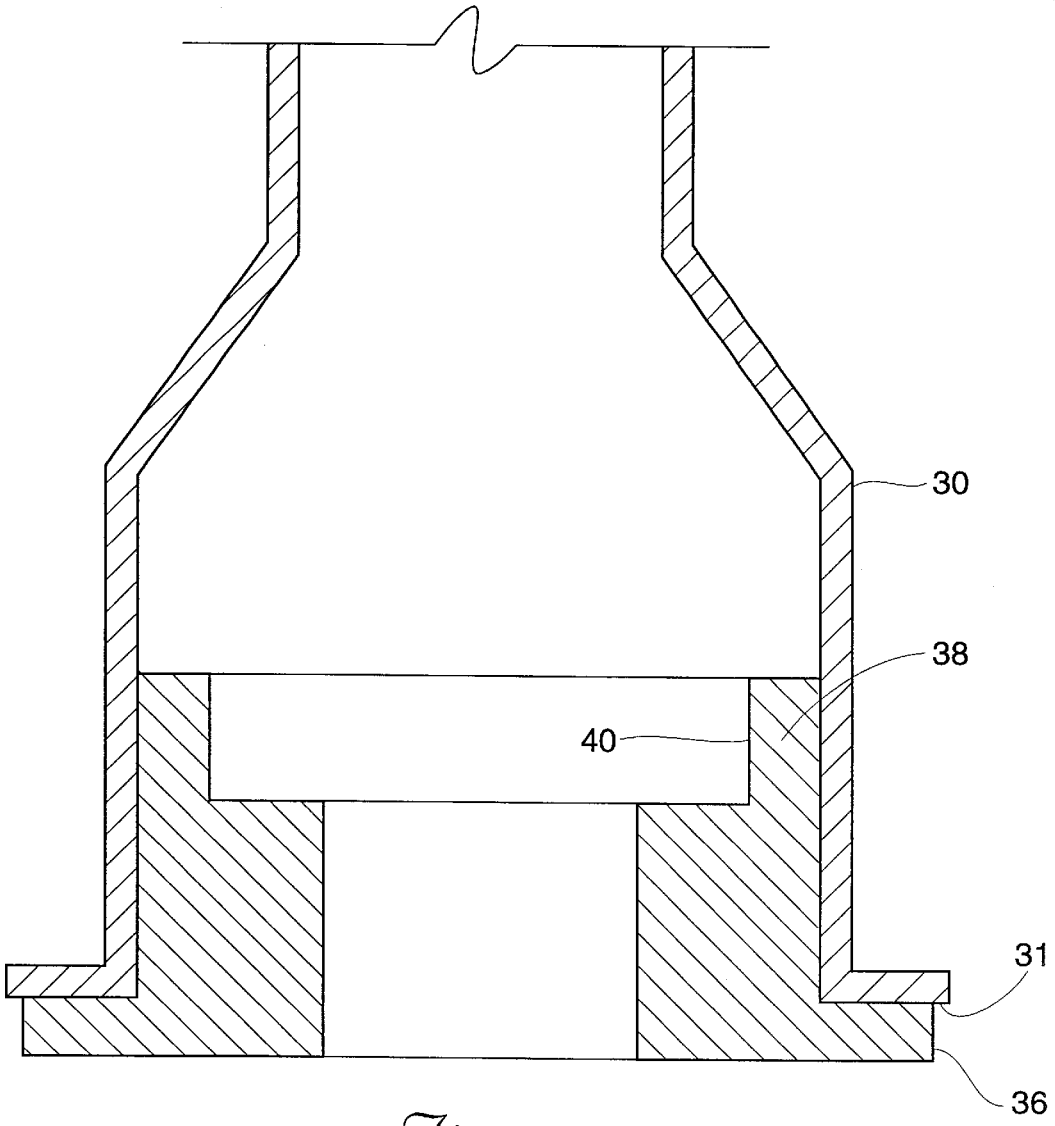
FIG. 41 discloses an internal seal for use with butterfly valves.

Referring now to FIGS. 41–44 another set of alternative embodiments of the valve box adaptor 10 may be seen. Referring to FIG. 41 a stepped version of the valve box adaptor 10 may be seen wherein the inner surface 40 of the valve box adapter is stepped. This structure is preferable where a butterfly type valve must be accommodated.

Figure 42:
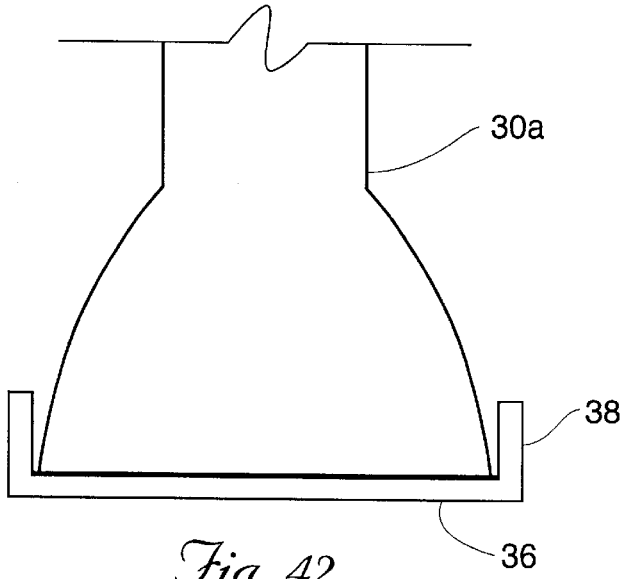
FIG. 42 discloses a cross sectional view of an alternative embodiment showing an external valve box seal.
Figure 43:
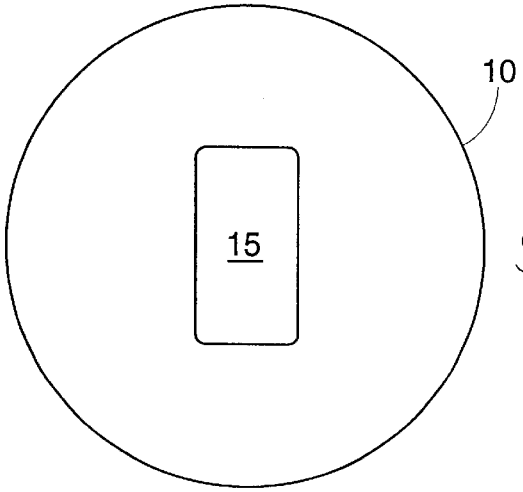
FIG. 43 shows a bottom plan view of the external valve box seal disclosed in FIG. 42.
Figure 44:
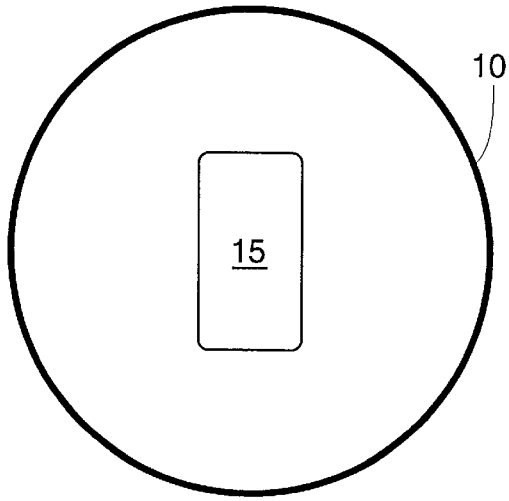
FIG. 44 discloses a top plan view of the external valve box adaptor seal disclosed in FIG. 42.

Referring to FIGS. 42–44 the valve box adaptor 10 may be seen to be provided with an opening 15 sufficient in size to accommodate the bonnet 18 of the valve 12. This type of structure is preferred where it is necessary to accommodate a large bonnet 30 onto a smaller valve structure 12 so that no gap is presented through which dirt or liquid may easily infiltrate and dislodge the bonnet 30 to a disadvantageous position.

Figure 58:
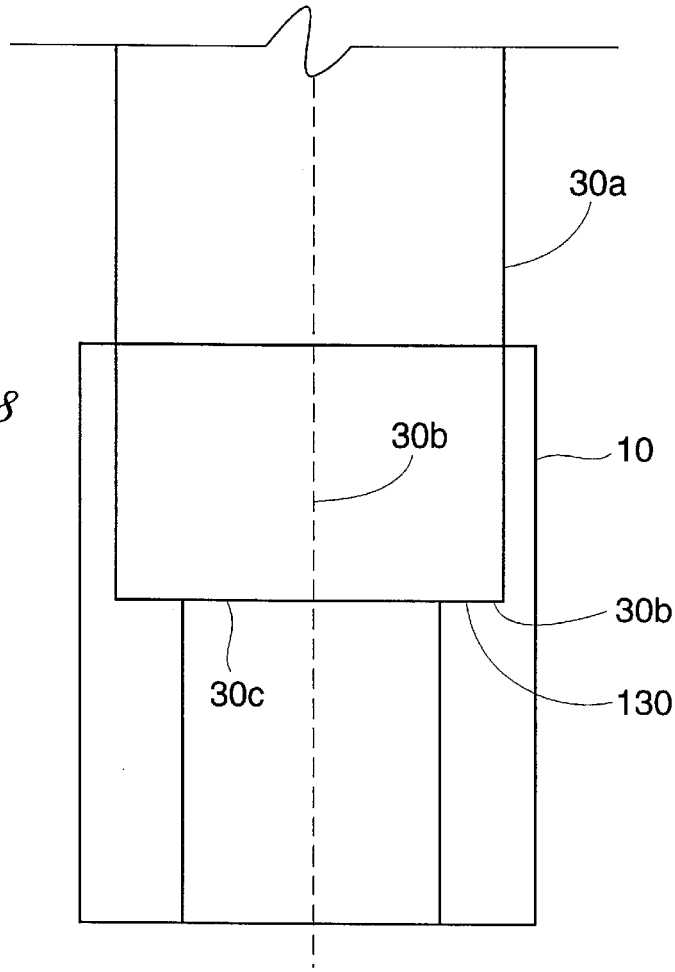
FIG. 58 discloses a side elevational cross sectional view of another embodiment of the gate valve adaptor.
Figure 58A:
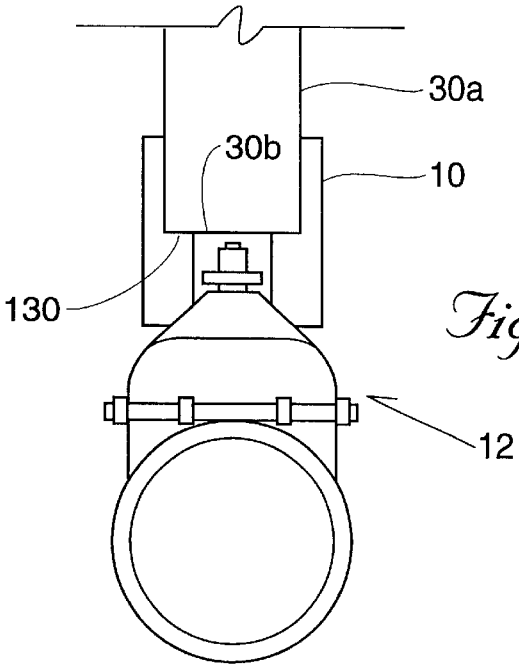
FIG. 58A discloses a side elevational cross sectional view of the gate vale adaptor disclosed in FIG. 58 in working conjunction with a gate valve assembly unit.

Additionally, referring to FIGS. 58 and 58A another alternative gate valve structure 10 may be seen. The device disclosed in FIGS. 58 and 58A is for use where a bonnet 30 is not desired and only a bonnet pipe or conduit 30A is used. The alternative gate valve sealing structure 10 is provided with a shoulder or internal flange 130. The internal flange 130 extends toward the center line 30B of pipe 30A. The bottom edge 30C of the bonnet pipe 30A being supported by internal flange 130.

FIGS. 15–31 and 48–55 disclose various liquid infiltration prevention structures 100 for preventing liquid infiltration into manhole assemblies 101. The manhole assemblies include a manhole frame or casting 113, which receives a manhole cover 114, and (typically) rests upon a series of concrete adjusting rings 116 which in turn may rest upon a manhole cone (not shown) to form a manhole chimney 115. The liquid infiltration prevention structures 100 are seals which function to eliminate or substantially reduce the surface water infiltration over the area that they span, whether the component parts are made of concrete, block, or brick.

The primary function of the invention is to seal between the casting 113 and the nearest section of the chimney 115 that is sound and impermeable to water or other liquid. This may involve spanning only a short distance below the casting 113 or it may require a span of part or all of the chimney 115.

Figure 15:
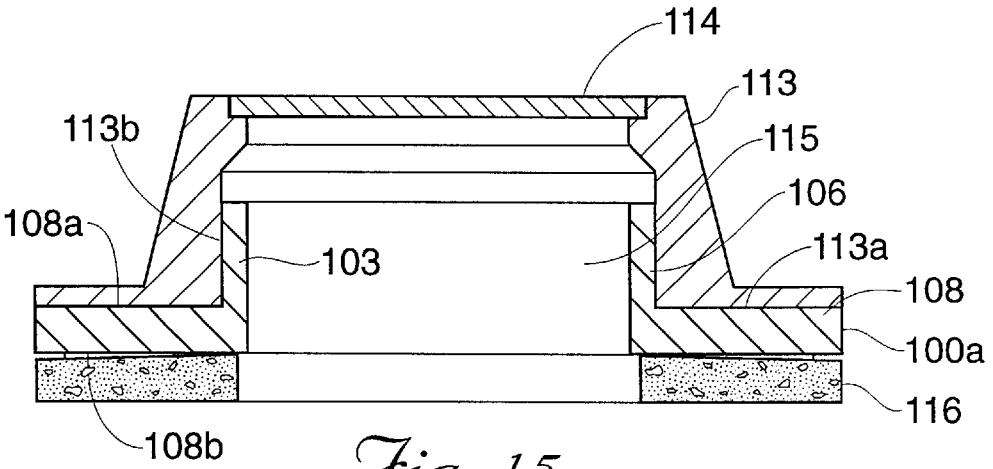
FIG. 15 discloses a cross sectional view of an internal manhole sealing structure for internally sealing a manhole casting.

Referring to FIG. 15 an internal seal 100A may be seen to include a ring 108 and an upward extension 106. Ring 108 includes a top surface 108*a* and a bottom surface 108*b*. Bottom surface 108*b* engages concrete rings 116 and top surface 108 engages bottom surface 113*a* of the manhole frame 113 such that extension 106 is located in the chimney 115 and outside surface 103 of extension 106 is in contact with inside surface 113*b* of the manhole frame 113.

Figure 15A:
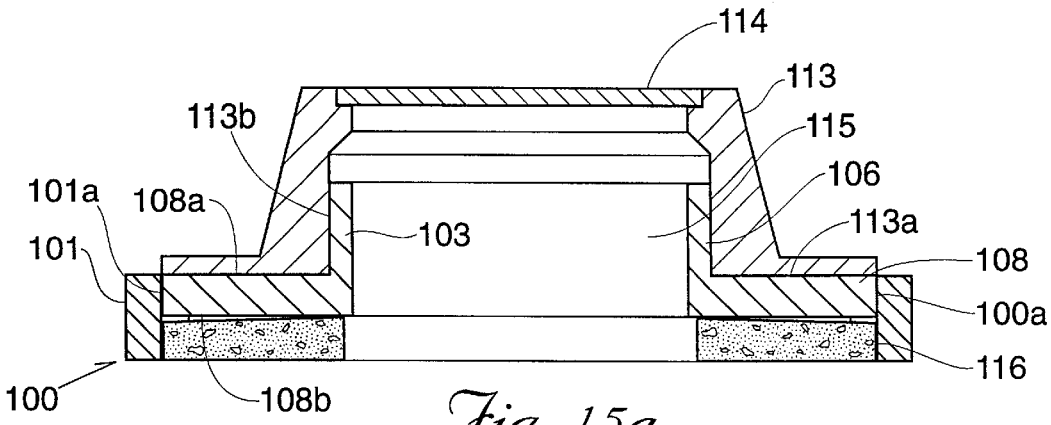
FIG. 15A discloses a cross sectional view of an alternative structure to the internal manhole sealing structure for internally sealing a manhole casting disclosed in FIG. 15.

Referring to FIG. 15A the internal seal 100A disclosed in FIG. 15 may be seen to be further modified by the including of a downwardly extending flange 101 integral to the edge 101A of the internal seal 100A. The downwardly extending flange 101 sealing either all or a predetermined portion of the external surface of the concrete rings 116. The downwardly extending flange 101 need not be integral to the internal seal 100A nor does it need to be made from the same material as the seal 100A.

Figure 16:
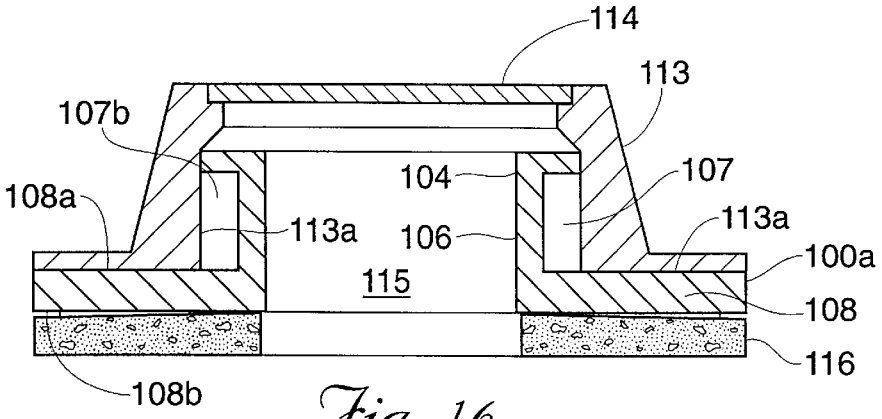
FIG. 16 shows a cross sectional view of an alternative embodiment of the internal manhole sealing structure of the present invention.

Referring now to FIG. 16 an alternative embodiment of the internal seal 100A may be seen to include a flange 107 extending from end 104 of extension 106. Flange 107 has an end 107*a* and is positioned such that end 107*a* engages a portions of the inside surface 113*b* of the manhole frame 113.

Figure 17:
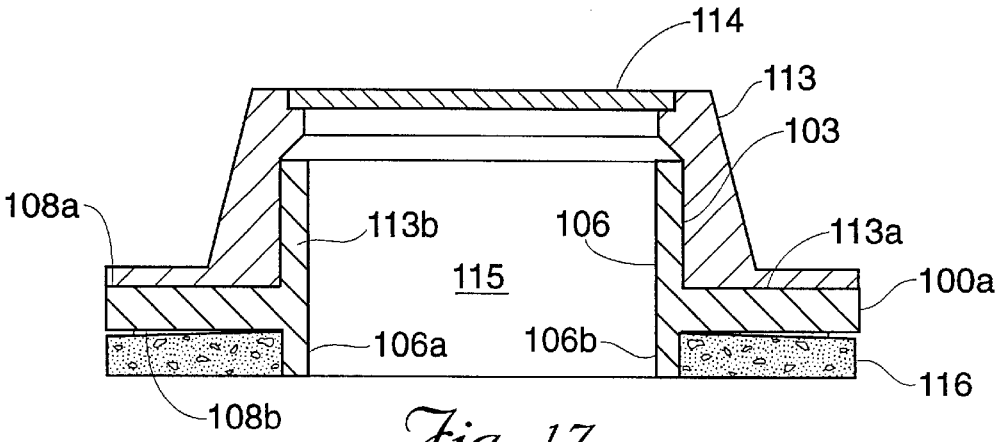
FIG. 17 discloses a cross sectional view of an alternative embodiment of the internal manhole sealing structure of the present invention.

Referring now to FIG. 17 another alternative embodiment of the internal seal 100A may bee seen. In this embodiment extension 106 includes an integral portion 106*a* which extends down the manhole chimney 115 in contact with the surfaces of the concrete rings 116.

Figure 18:
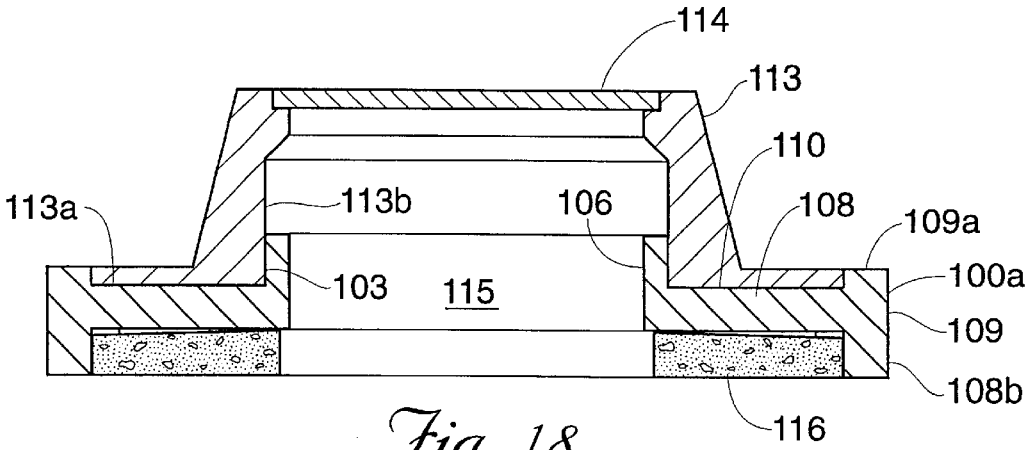
FIG. 18 discloses a cross sectional view of an alternative embodiment of the internal manhole sealing structure of the present invention showing both internal and external sealing structures.

Referring now to FIG. 18 another alternative embodiment of the internal seal 100A may be seen. In this embodiment the internal seal 100A includes an edge flange 109 having an upper extension 109*a* and a lower extension 109*b*. Extension 109*b* forms a seal against the concrete rings 116 and extensions 109*a* and 106 along with ring 108 form a channel 110 into which bottom 113*a* of the manhole frame 113 is seated. This provides additional stability to the manhole frame 113, dampens shock transference from passing traffic (as do all the seals 100A), and provides sealing internal to the manhole frame 113 and external to the concrete rings 116.

Figure 19:
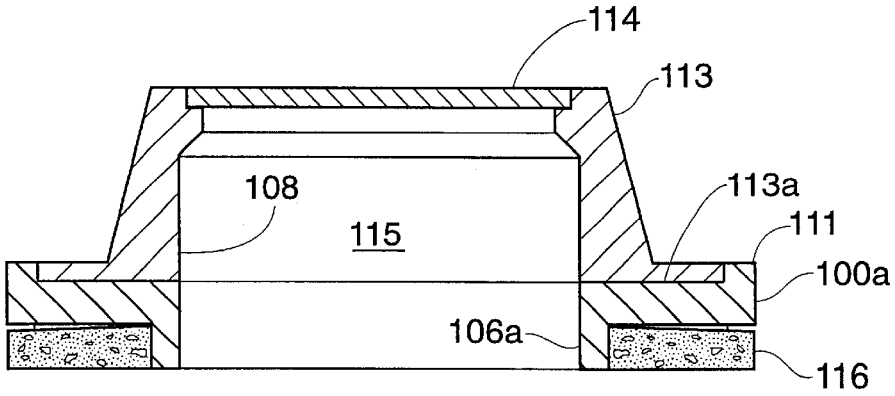
FIG. 19 discloses a cross sectional view of an alternative embodiment of the internal manhole sealing structure.

Referring now to FIG. 19 another alternative embodiment to the seal 100A may be seen. In this embodiment the manhole frame 113 sets on ring 108 and there is no upward extension 106. Only a downward extension 106*a* is provided. Additionally, an upwardly turned flange 111 is provided to aid in seating the manhole frame 113 on the seal 100A. Accordingly, there is an internal seal against the concrete rings 116 that are in contact with extension 106*a*.

Figure 20:
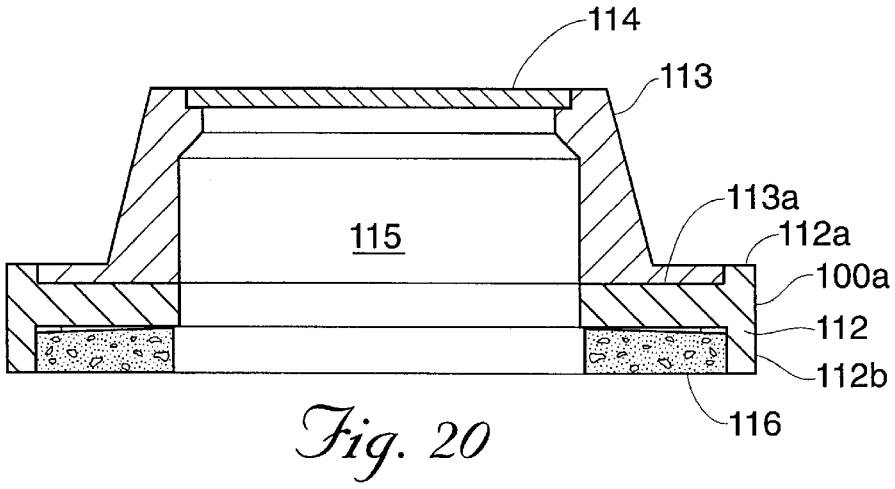
FIG. 20 discloses a cross sectional view of an alternative embodiment of the internal manhole sealing structure.

Referring now to FIG. 20 another embodiment of the present invention may be seen. In this embodiment seal 100A has no extension along the inside surfaces of the manhole chimney 115. Instead an external flange 112, similar to external flange 111 in FIG. 19, is provided. External flange 112 has an upward extension 112*a* and a downward extension 112*b*. Accordingly, a seal is formed between the bottom 133*a* of the manhole frame 113 and the outside surface of the concrete rings 116.

Figure 21:
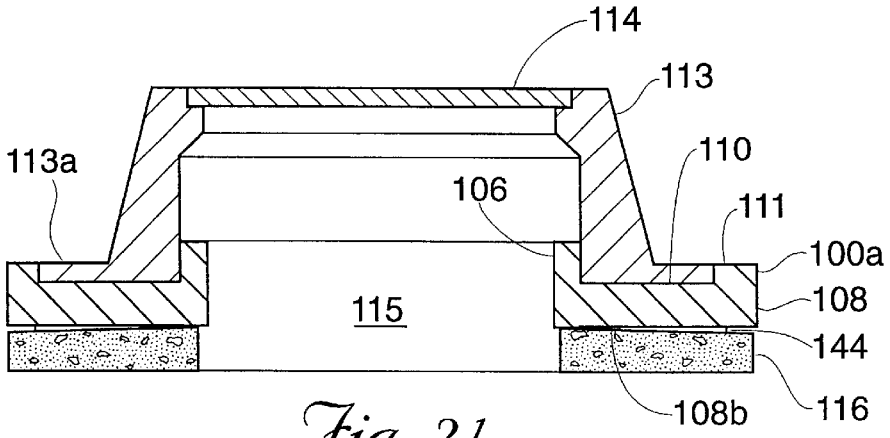
FIG. 21 closes a cross sectional view of an alternative embodiment of the internal manhole sealing structure of the present invention.

Referring now to FIG. 21 another alternative embodiment of the present invention may be seen. In this version of the present invention the seal 100A includes extension 106 and flange 111. No downward extensions are included. Accordingly, channel 110 is formed between extension 106 and flange 111. Bottom 113*a* of manhole frame 113 rests in channel 110. Butyl rubber may be placed between the bottom 108*b* of the ring 108 and the concrete rings 116 to enhance the seal formed and to help reduce any lateral movement of the seal 100A.

Figure 22:
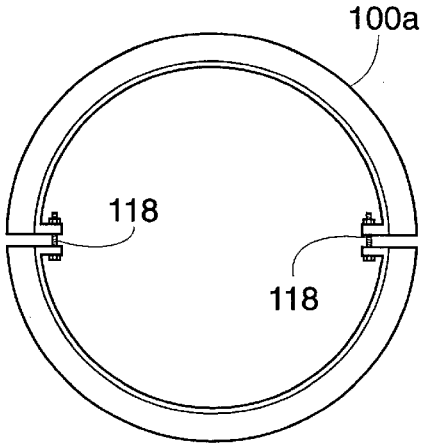
FIG. 22 shows a top plan view of an internal manhole sealing structure having a securing band structure.
Figure 23:
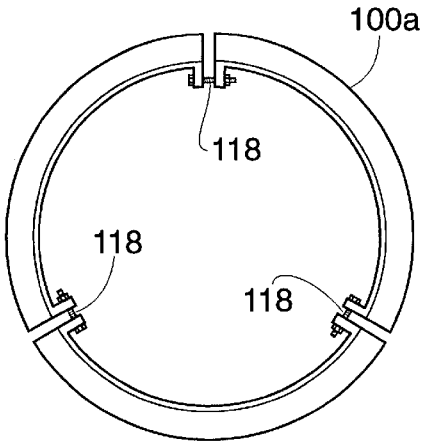
FIG. 23 discloses a top plan view of an alternative embodiment of the present invention disclosed in FIG. 22.
Figure 24:
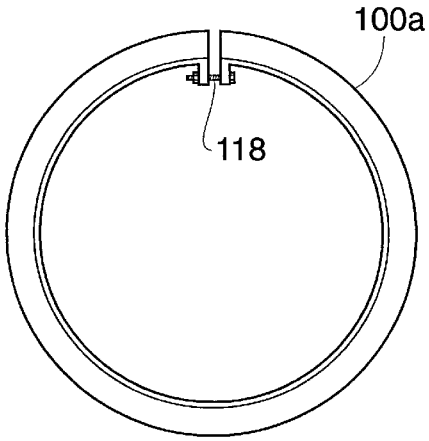
FIG. 24 is top plan view disclosing an alternative embodiment of the present invention disclosed in FIGS. 22 and 23.
Figure 24A:
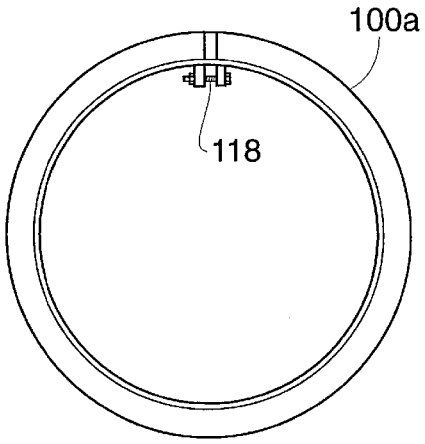
FIG. 24A is a top plan view disclosing an additional alternative embodiment of the present invention disclosed in FIGS. 22–24 showing the internal seal to comprise a ring and have an internal securing band which may be adjusted by means of the bolt mechanism shown.

Referring now to FIGS. 22–23 it may be seen that the seal 100A need not be one continuous ring or donut but may be made of a plurality of sections held together by expansion bolts 118. Additionally, the use of a structure composed of a plurality of sections may be desirable where adjustment of fit of the seal is an issue. Further, as illustrated in FIGS. 24 and 24A an adjustable seal having an expansion bolt may be made of only one section also. The seal 100A may be one continuous ring as shown FIG. 24A or it may have a space as shown in FIG. 24.

Figure 25:
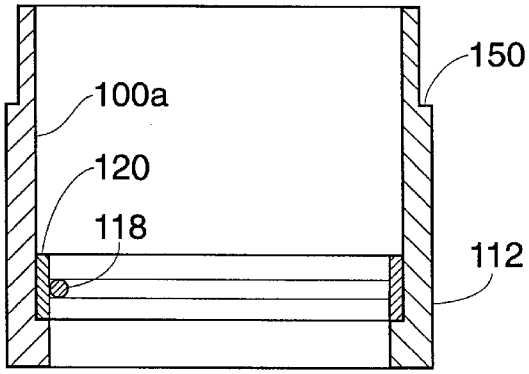
FIG. 25 discloses a side cross sectional view of an internal adaptor seal having an internal securing band.
Figure 27:
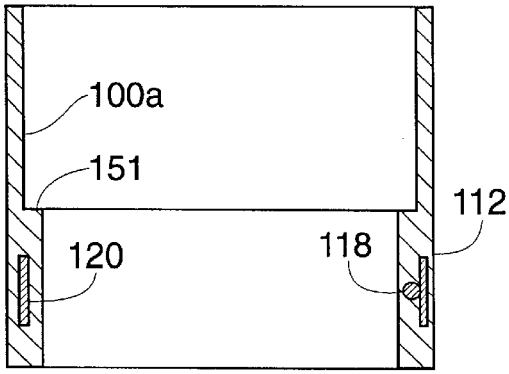
FIG. 27 discloses a cross sectional view of an alternative embodiment of the internal manhole seal disclosed in FIG. 25.
Figure 28:
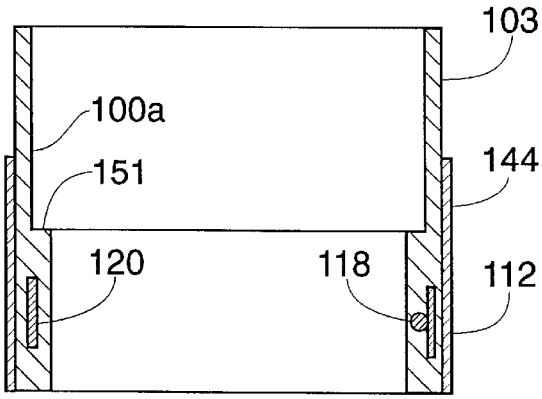
FIG. 28 discloses a cross sectional view of an alternative embodiment of the internal manhole seal disclosed in FIGS. 25 and 27.

Referring now to FIGS. 25–28 an alternative internal adjustable seal 100A may be seen. As illustrated in FIG. 25 the internal seal 100A may include at least one securing band 120 which can be adjusted by use of expansion/securing bolt 118 to hold the base portion 112 in tight or tighter sealing contact with the inside surface of the manhole chimney 115. The internal seal may also be made so that it includes an external shoulder 150 for receiving or supporting conduit structures or mechanisms which may be placed on top of the seal 100A. Further, as FIG. 27 illustrates the securing band 120 may be located so that it is internal to the base portion 112 of the seal 100A and thus more protected from the internal conditions found in the manhole chimney 115. Additionally, the internal seal 100A may be provided with an internal shoulder 151 for receiving or supporting conduit structures or mechanisms that may be extended into the internal seal 100A. Also, as illustrated in FIG. 28, the internal seal 100A may have butyl rubber or similar material 144 applied to a predetermined portion of its outer surface 103. This will also aid in holding the seal 100A in the desired position in contact with the desired internal surfaces of the manhole chimney 115. Accordingly, it will be apparent to a person reading this disclosure, at least a person or ordinary skill in the art, that the above noted features disclosed in FIGS. 25–28 may be interchanged between the embodiments specifically disclosed to produce other equally effective or equivalent structures.

Referring now to FIGS. 29–31, 40, 45–57, and 59–60A a variety of external seal structures 100B may be seen.

Figure 29:
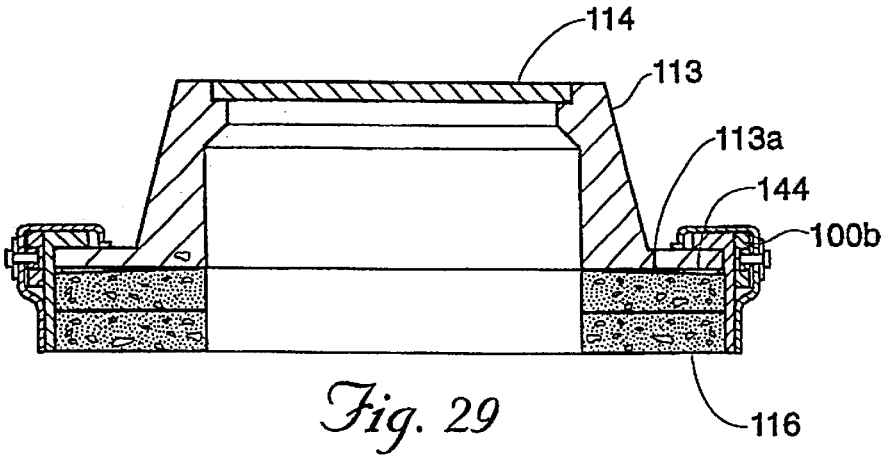
FIG. 29 discloses a cross sectional view of an external sealing structure for externally sealing a manhole casting.
Figure 30:
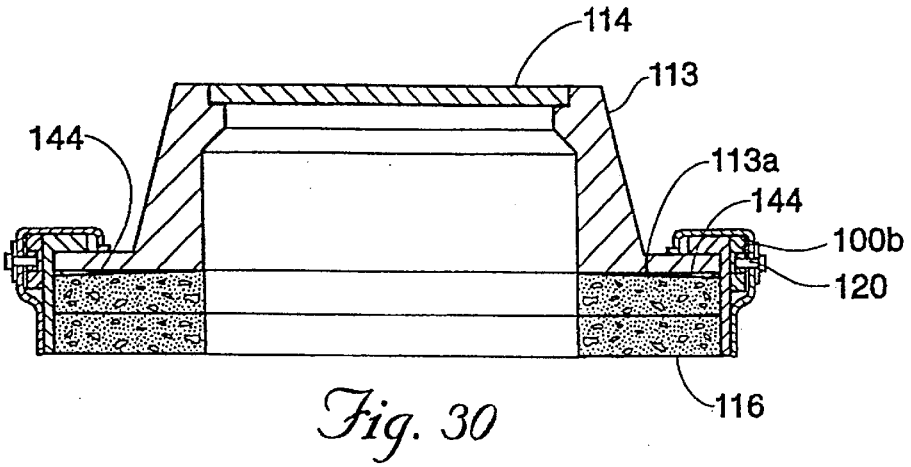
FIG. 30 discloses a cross sectional view of an alternative external manhole casting sealing structure from that disclosed in FIG. 29.

Referring to FIG. 29 the external seal 100B may be seen to be a sheath which extends from surface 113A of the manhole frame 113 and down the external sides of the concrete adjusting rings 116. In FIG. 30 the external seal 100B disclosed in FIG. 29 may be seen to be held in place with an alternative securing band 120.

Figure 31:
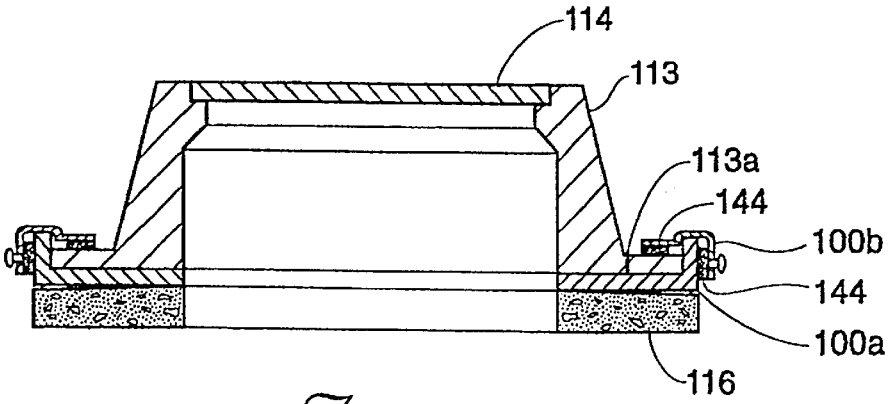
FIG. 31 discloses a cross sectional view of an external manhole casting sealing structure alternative to ones disclosed in FIGS. 29 and 30.

Referring now to FIG. 31 the external seal 100B may be shown to be used in conjunction with an internal seal 100A. The external seal 100B extends from the top surface 113A of the manhole frame 113 to the external side surface of the internal seal 100A. The external seal 100B is held in place by butyl rubber 144 as shown in FIG. 31. The external seal 100B may also be held in place mechanically.

Figure 40:
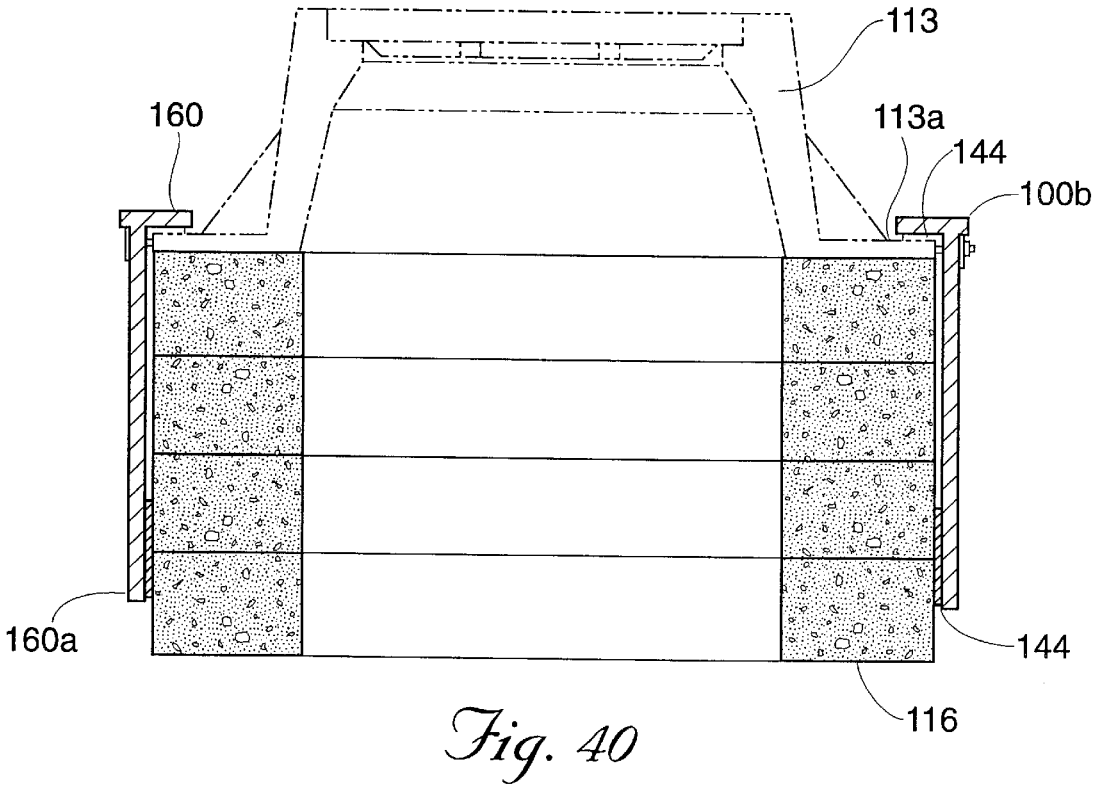
FIG. 40 discloses a cross sectional view of an external sealing structure for use in conjunction with a manhole casting for externally sealing the manhole assembly.
Figure 45:
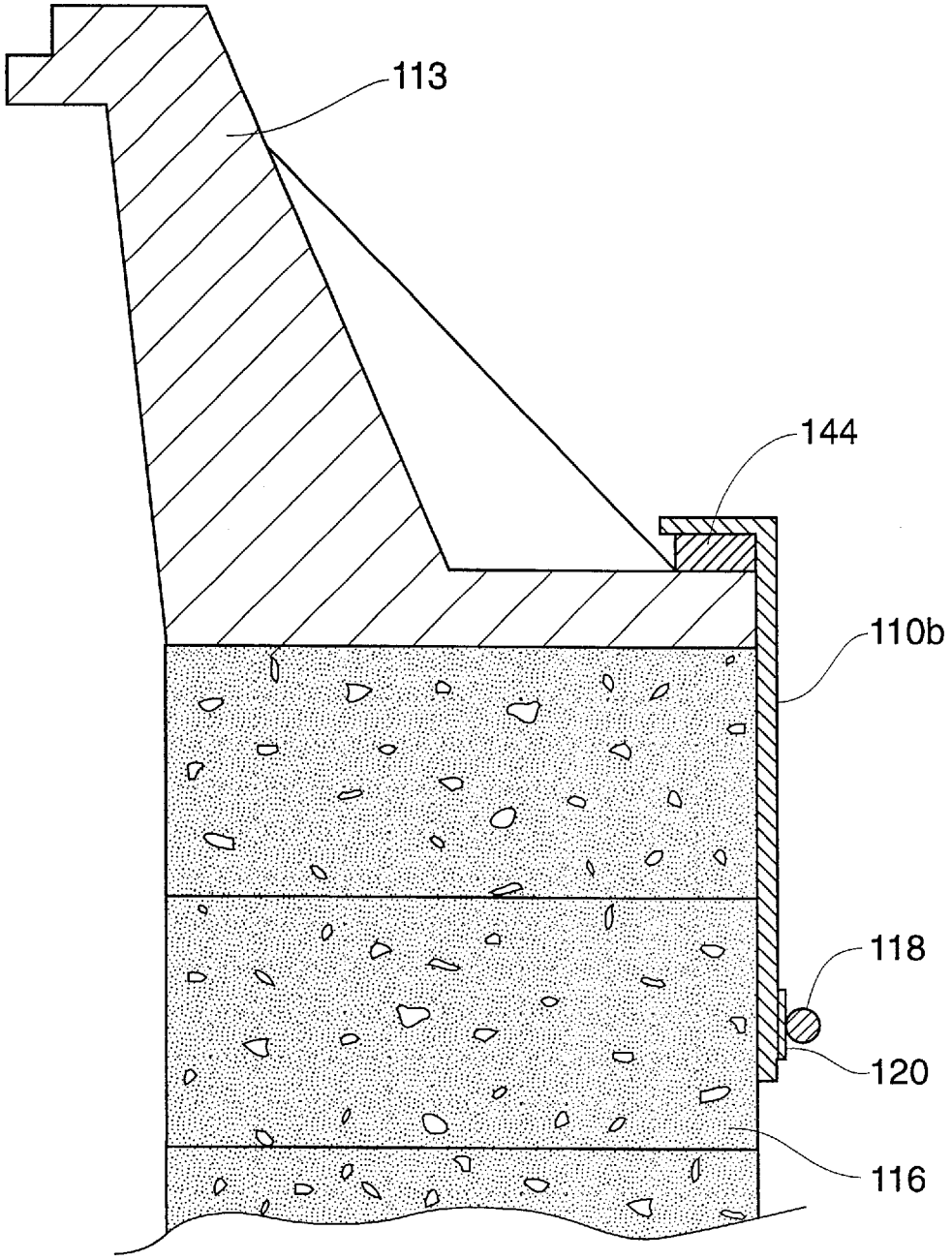
FIG. 45 discloses a sectional view of an external sealing structure for use in conjunction with a manhole assembly showing a portion of the manhole frame and the external sealing structure and the concrete rings.

Referring now to FIG. 40 another alternative embodiment of the external seal 100B may be seen. In this embodiment a flange 160 may be seen to extend over the surface 113A of the manhole frame 113. The flange 160 is held in place by butyl rubber 144. The remainder of the external seal 100B extends downward from the flange 160 covering a predetermined portion of the outside surface of the adjustment rings 116. The portion of the external seal 100B covering a predetermined portion of the adjustment rings 116 may also be held in place with the addition of a securing mechanism like butyl rubber 144 or alternatively, as illustrated in FIG. 45 a securing band 120. Additionally, it may be seen from this drawing that the lower portion 160A may be covered with an additional sealing mechanism like a rubber sleeve or sheath.

Figure 46:
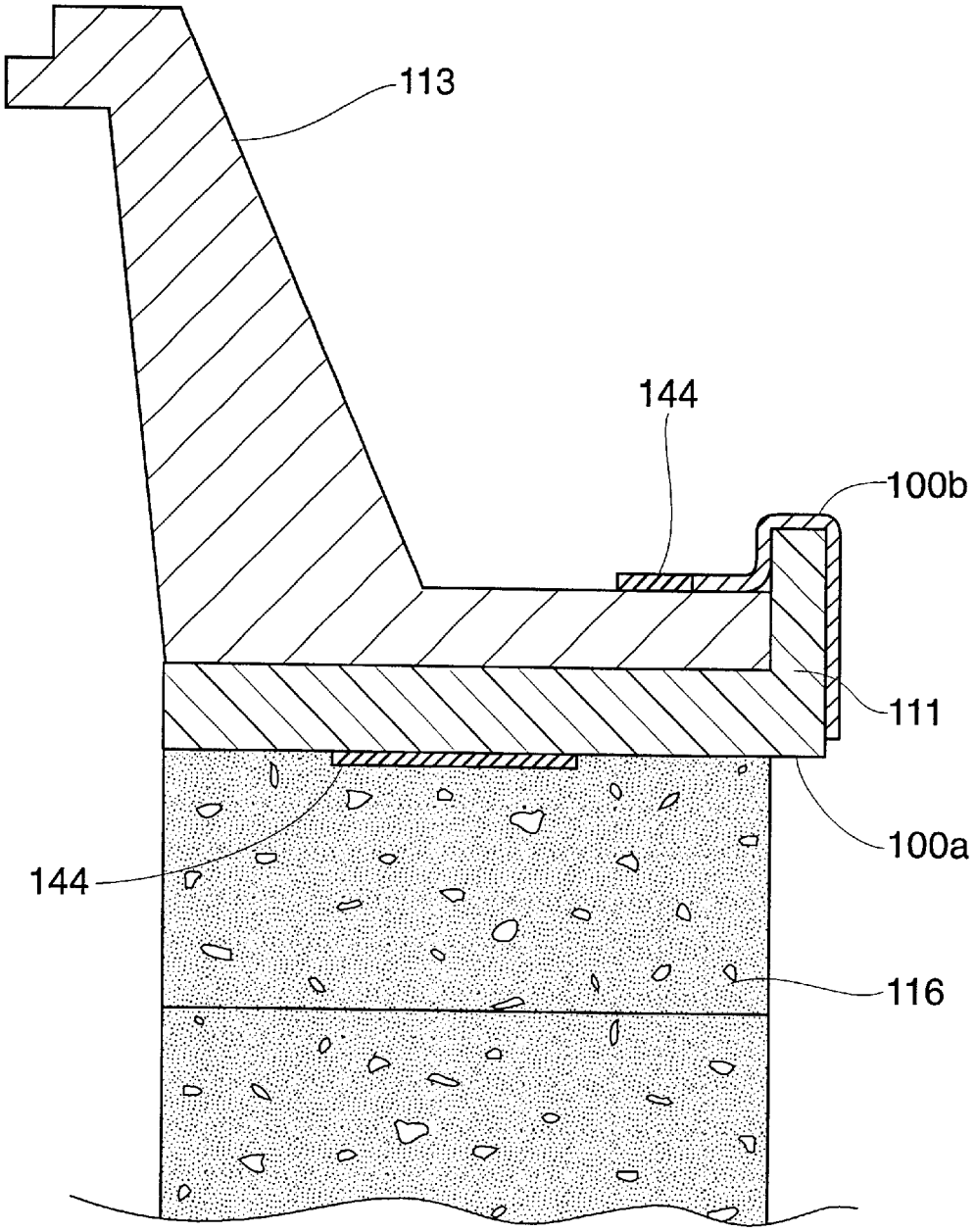
FIG. 46 discloses a sectional view, like the one shown in FIG. 45, of an alternate external sealing structure for use in conjunction with a manhole assembly.

Referring to FIG. 46 specifically and FIG. 31 generally the external seal 100B may also be constructed integral to the internal seal 100A. In this embodiment butyl rubber 144 may be used to hold a portion of the external seal 100B on the surface 113A of the manhole frame 113. The remainder of the external seal 100B being integral to the flange 111 of the internal seal 100A.

Figure 47:
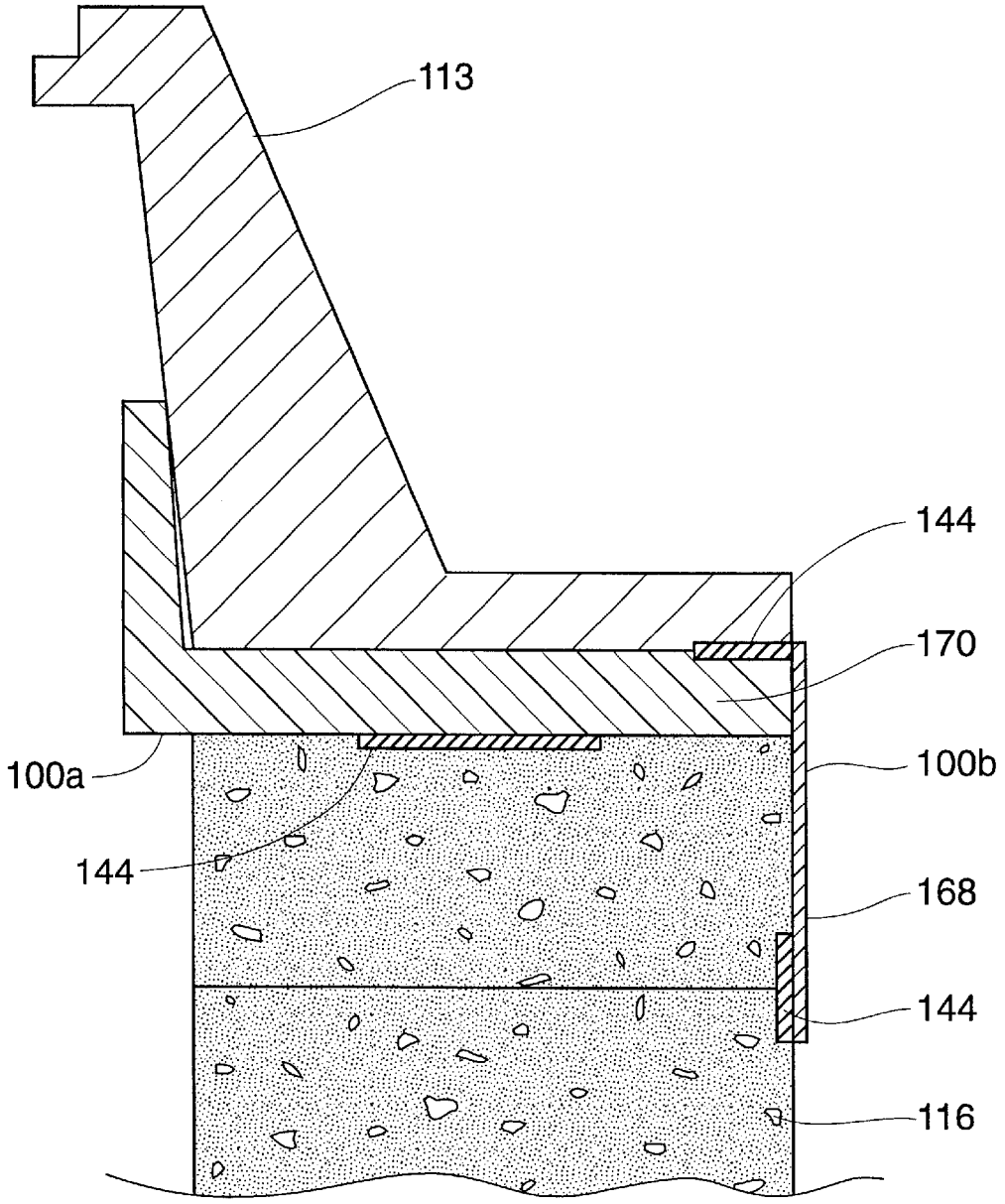
FIG. 47 discloses a sectional view, like the one shown in FIG. 45, of an alternative embodiment of the manhole sealing structure of the present invention.
Figure 47A:
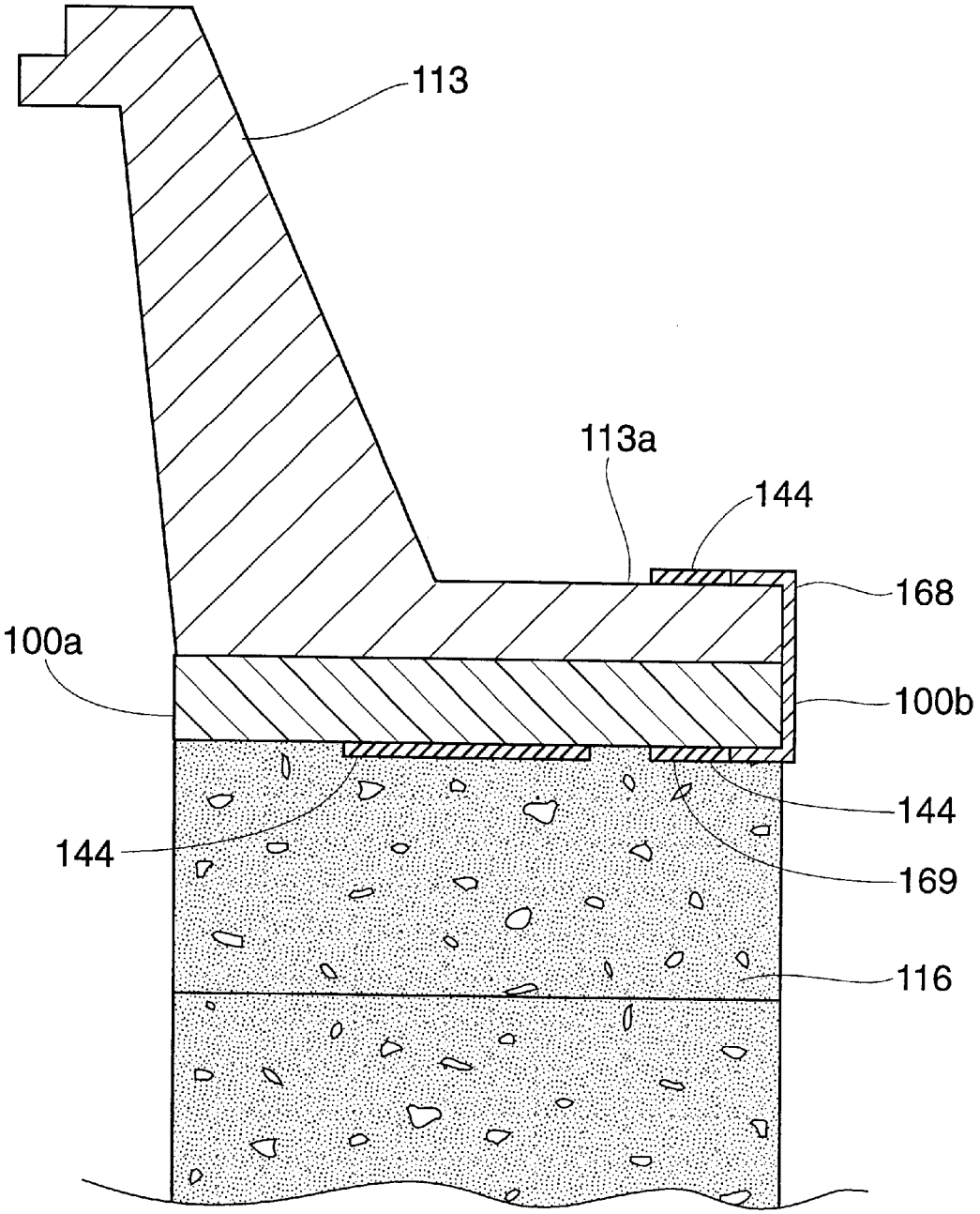
FIG. 47*a* discloses a sectional view, like the one shown in FIG. 45, of another alternative embodiment of the manhole sealing structure of the present invention.

Referring to FIG. 47 another way of combining the external seal 100B with the internal seal 100A may be seen. In this embodiment the internal seal 100A and the external seal 100B may be seen to be integral to each other at section 170. The internal seal 100A being held in place by the weight of the manhole frame 113 and, optionally, also by the use butyl rubber applied to the top surface of the top adjustment ring 116. The external seal 100B having a portion 168 extending down over a predetermined portion of the adjustment rings 116 and being secured in place with butyl rubber 144 or some other securing mechanism or means for securing. Referring to FIG. 47A the structure of FIG. 47 may alternatively be performed by extending portion 168 upward so that instead of extending down over the external surfaces of the adjustment rings it is secured to surface 113A of manhole frame 113 and end 169 is secured to the internal seal 100A.

Figure 48:
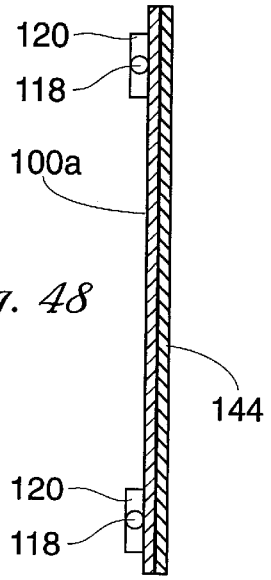
FIG. 48 discloses a side cross sectional view an internal manhole sealing structure which is yet another alternative embodiment of the sealing structures disclosed in the present invention.
Figure 49:
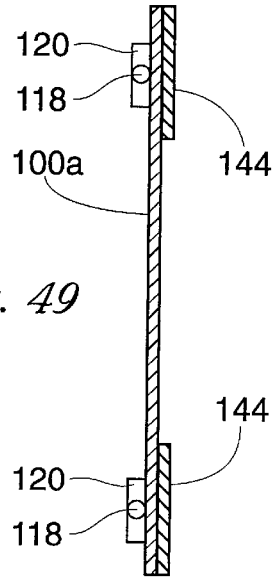
Figure 50:
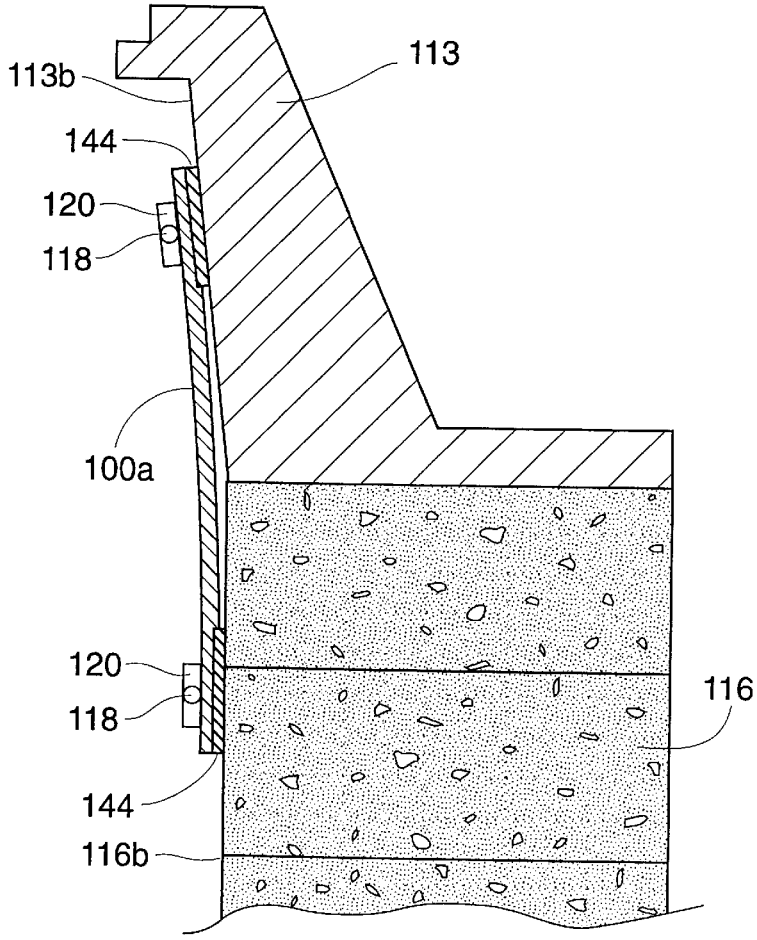
FIG. 50 discloses a sectional view, like the one shown in FIG. 45, of an internal manhole sealing structure in conjunction with a manhole assembly using the device disclosed in FIG. 49.

Referring now to FIGS. 48–50 an alternative internal seal 100A may be seen in which the internal seal 100A comprises a rubber sleeve having ends C and D.

End C being secured to the internal surface 113B of the manhole frame 113 and the seal 100A extending from End C to End D which is secured to the internal surface 116B of the adjusting rings 116. Accordingly, the seal 100A covers and seals a predetermined portion of the inside surface 113B of the manhole frame 113 and a predetermined portion of the inside surface 116B of the adjusting rings 116.

Figure 51:
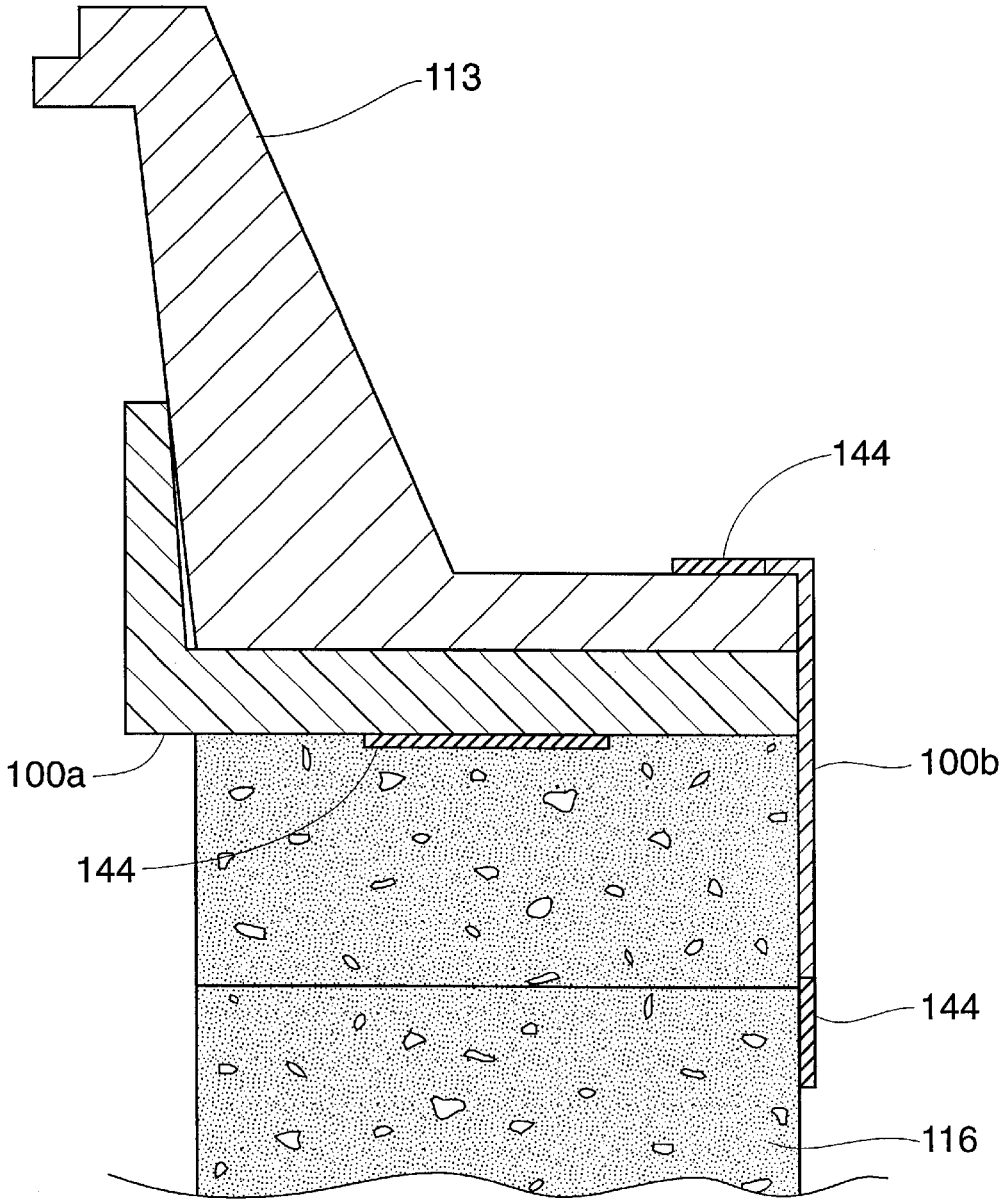
FIG. 51 discloses a sectional view, like the one shown in FIG. 45, of an alternative manhole assembly sealing structure.
Figure 51A:
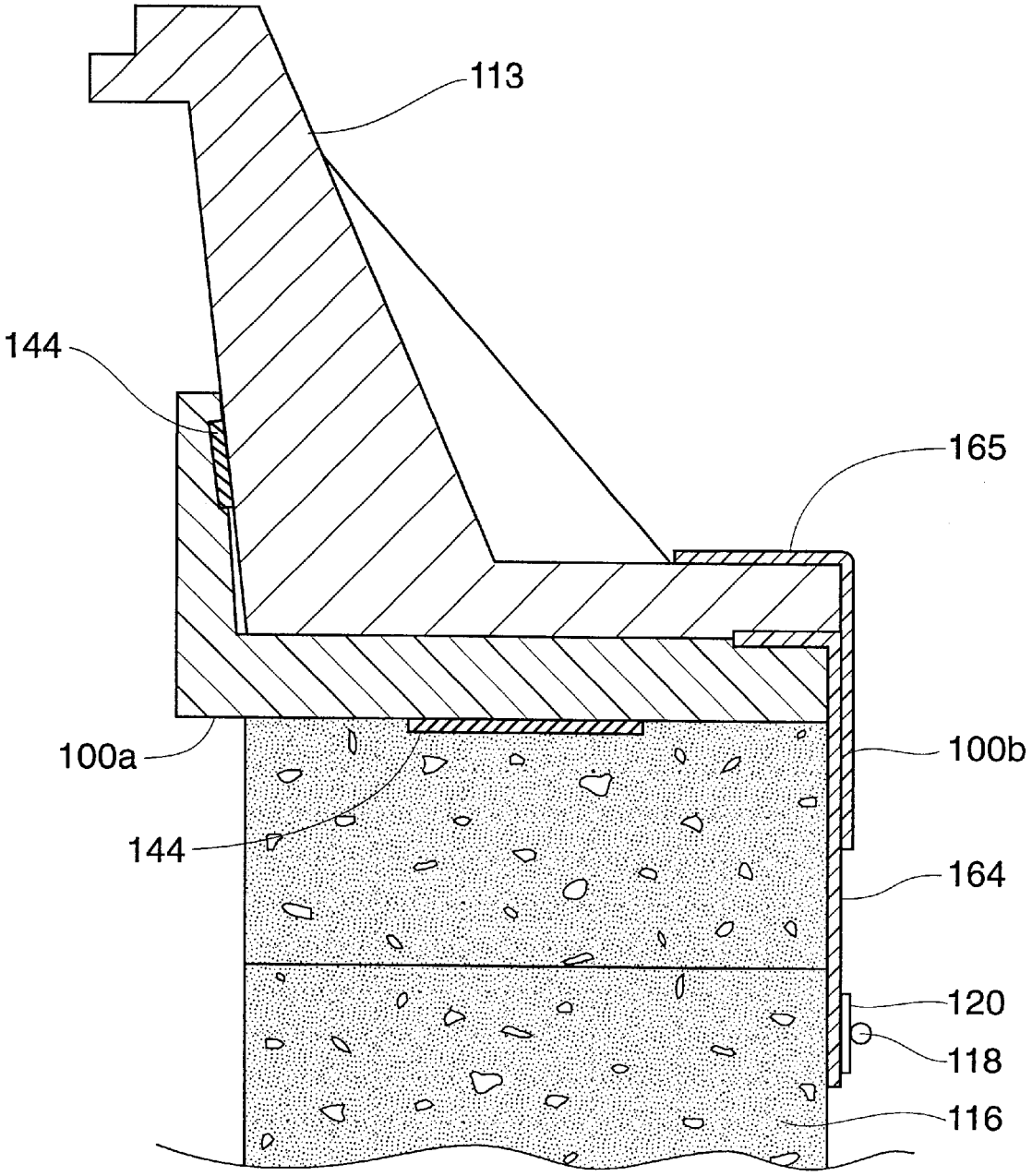
FIG. 51A discloses a sectional view, like the one shown in FIG. 45, of an alternative manhole assembly sealing structure.

Referring now to FIGS. 51 and 51A another alternative embodiment to the sealing structures disclosed in FIGS. 46 and 47 may be seen. In the embodiment shown in FIG. 51 the external seal 100B may extend from the top surface 113A of the manhole frame 113 down over a predetermined portion of the external surfaces of the adjusting rings 116. The ends of the external seal 100B may be held in place by the use of butyl rubber 144. In FIG. 51A the seal 100B expressed in FIG. 51 may be alternatively expressed as the combination of a primary rubber sleeve 164 overlapped by a secondary rubber sleeve 165 as illustrated in FIG. 51A. The structure disclosed in FIG. 51A is considered at this time to be the best sealing structure for the particular purpose of the present invention.

Figure 52:
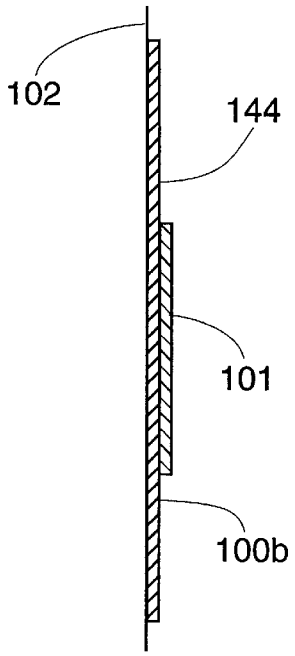
FIG. 52 discloses cross sectional view of an external manhole sealing structure.
Figure 53:
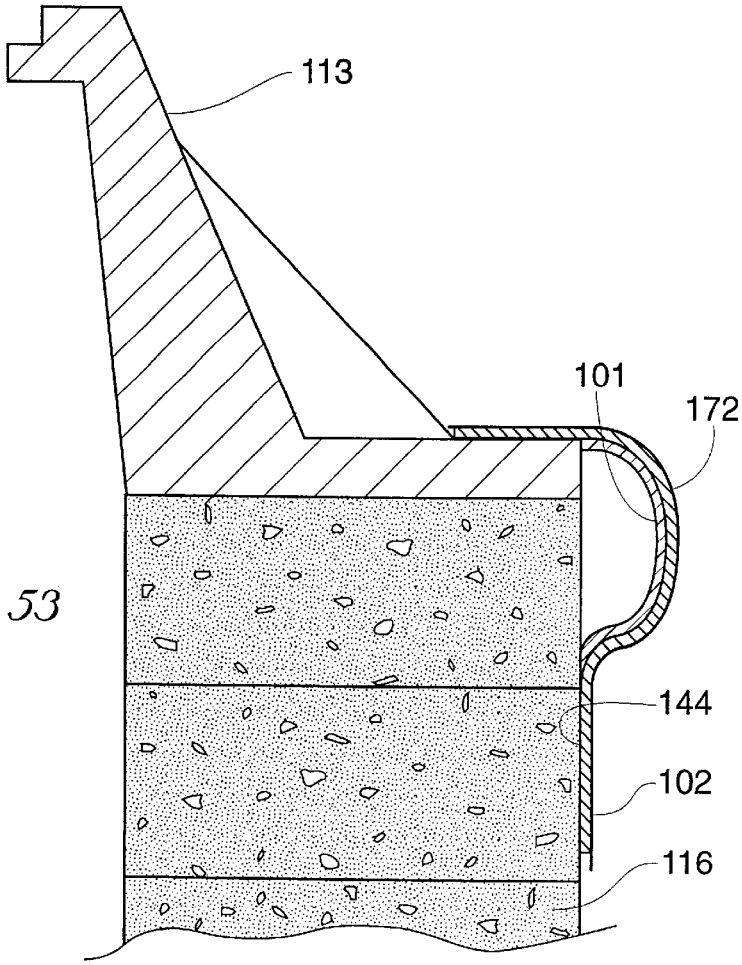
FIG. 53 discloses a sectional view, like the one shown in FIG. 45, of the external manhole structure being used in conjunction with the manhole assembly.
Figure 54:
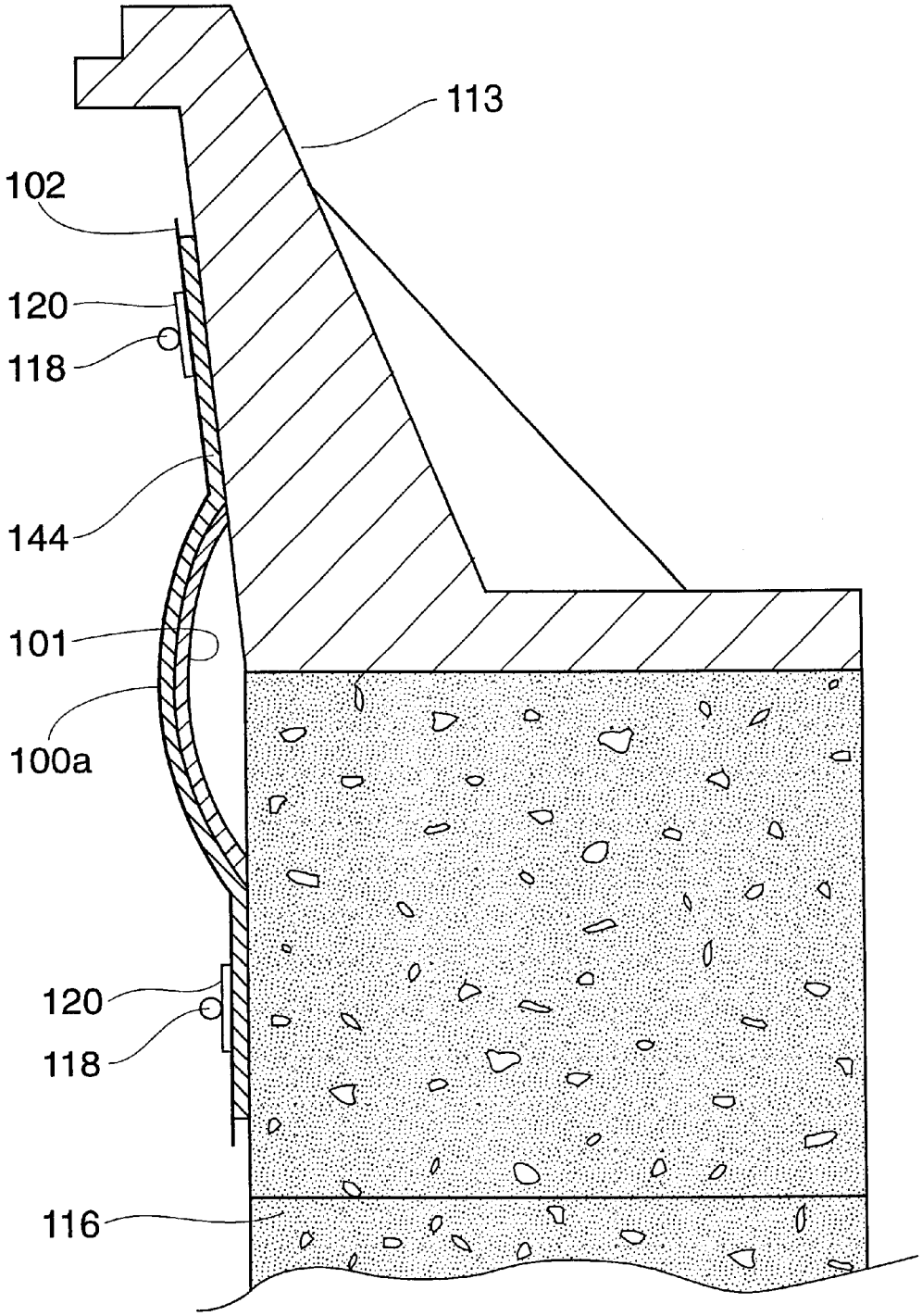
FIG. 54 shows a sectional view, like the one shown in FIG. 45, of an alternate embodiment to the structure disclosed in FIG. 50.

Referring now to FIGS. 52 and 53 another embodiment of the external seal may be seen. In this embodiment the seal 100B may be seen to be comprised of a layer of plastic or rubber 102 coupled to a layer of butyl rubber 144 which is in turn coupled to a smaller layer of rubber or plastic 101. This seal 100B may be mounted to the manhole frame surface 113A and the adjusting rings 116 as shown in FIG. 53. As FIG. 53 illustrates a bent portion 172 is produced that may flex as the manhole frame or sting rings move over time do to expansion and contraction or any other force which may act upon these structures. Additionally, the seal 100B may be used internally as illustrated by FIG. 54.

Figure 55:
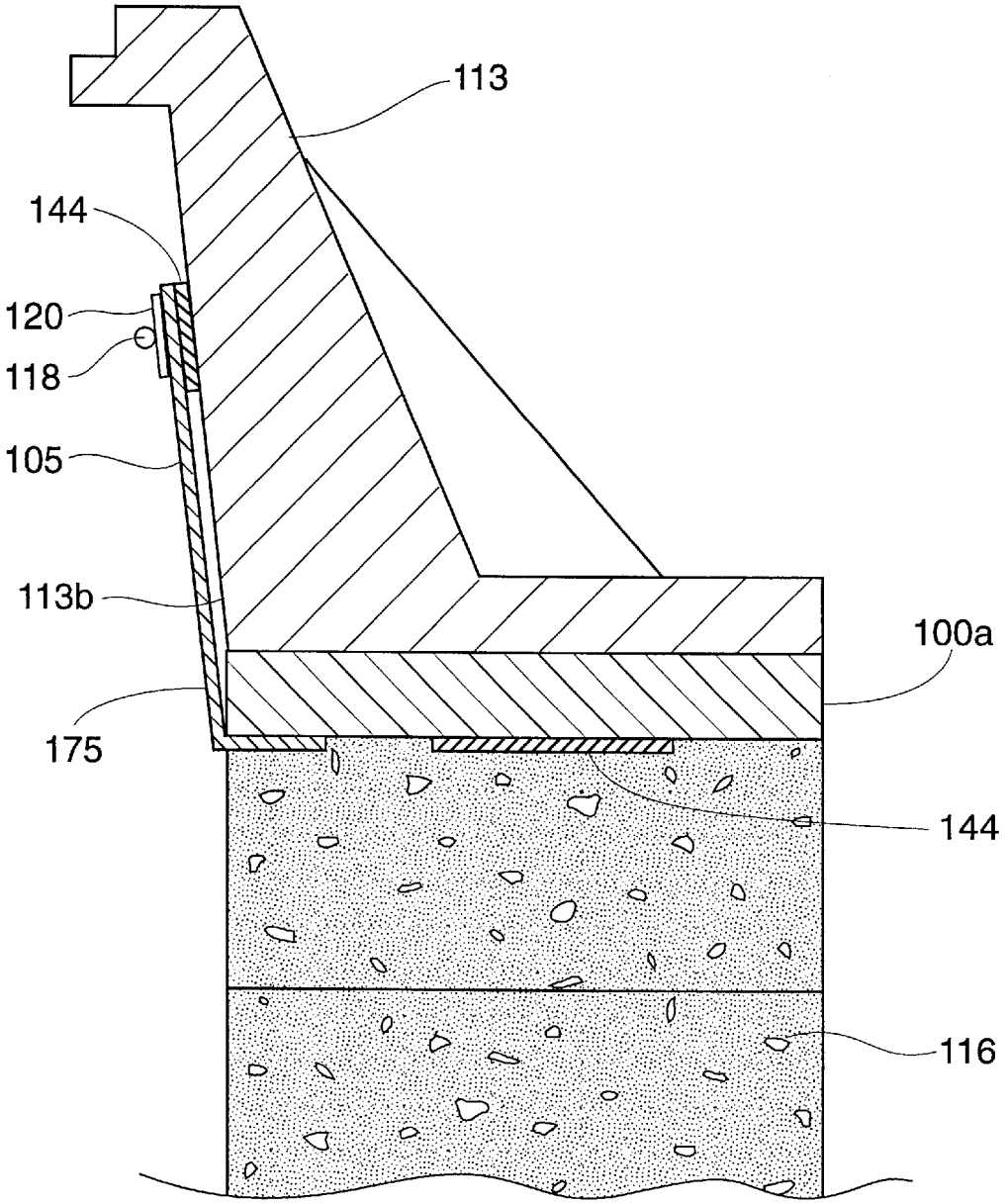
FIG. 55 discloses a sectional view, like the one shown in FIG. 45, of an alternative embodiment of the internal adaptor sealing structure of the present invention.

Referring now to FIG. 55 another alternative internal seal 100A may be seen. In this embodiment a rubber sleeve 105 is attached to the main portion 175 of the seal 100A. The sleeve 105 extends into the manhole chimney 115 and is mounted to the internal surface 113B of the manhole frame 113.

Figure 56:
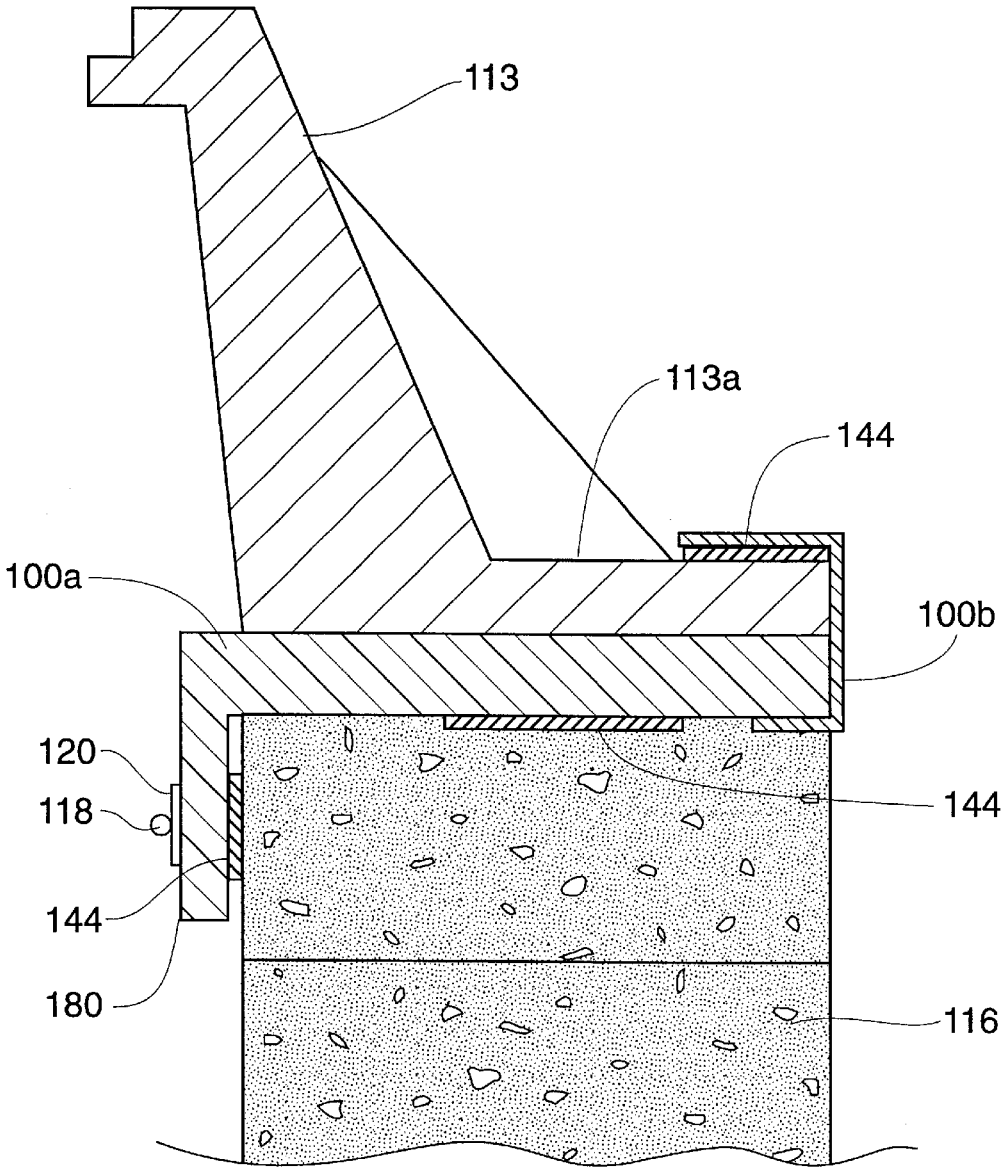
FIG. 56 discloses a sectional view, like the one shown in FIG. 45 of the manhole assembly, of another alternative embodiment of the internal sealing structure of the present invention.

Referring now to FIG. 56 another sealing structure combining features of the internal seal 100A and the external seal 100B may be seen. In this embodiment the internal seal 100A is provided with a downwardly extending flange 180 which may optionally be secured in place with either or neither a securing band 120 or butyl rubber 144. The external seal 100B is integral to the outer edge of the seal 100A and extends up onto surface 113A of the manhole frame 113 where it is held in place with butyl rubber 144.

Figure 57:
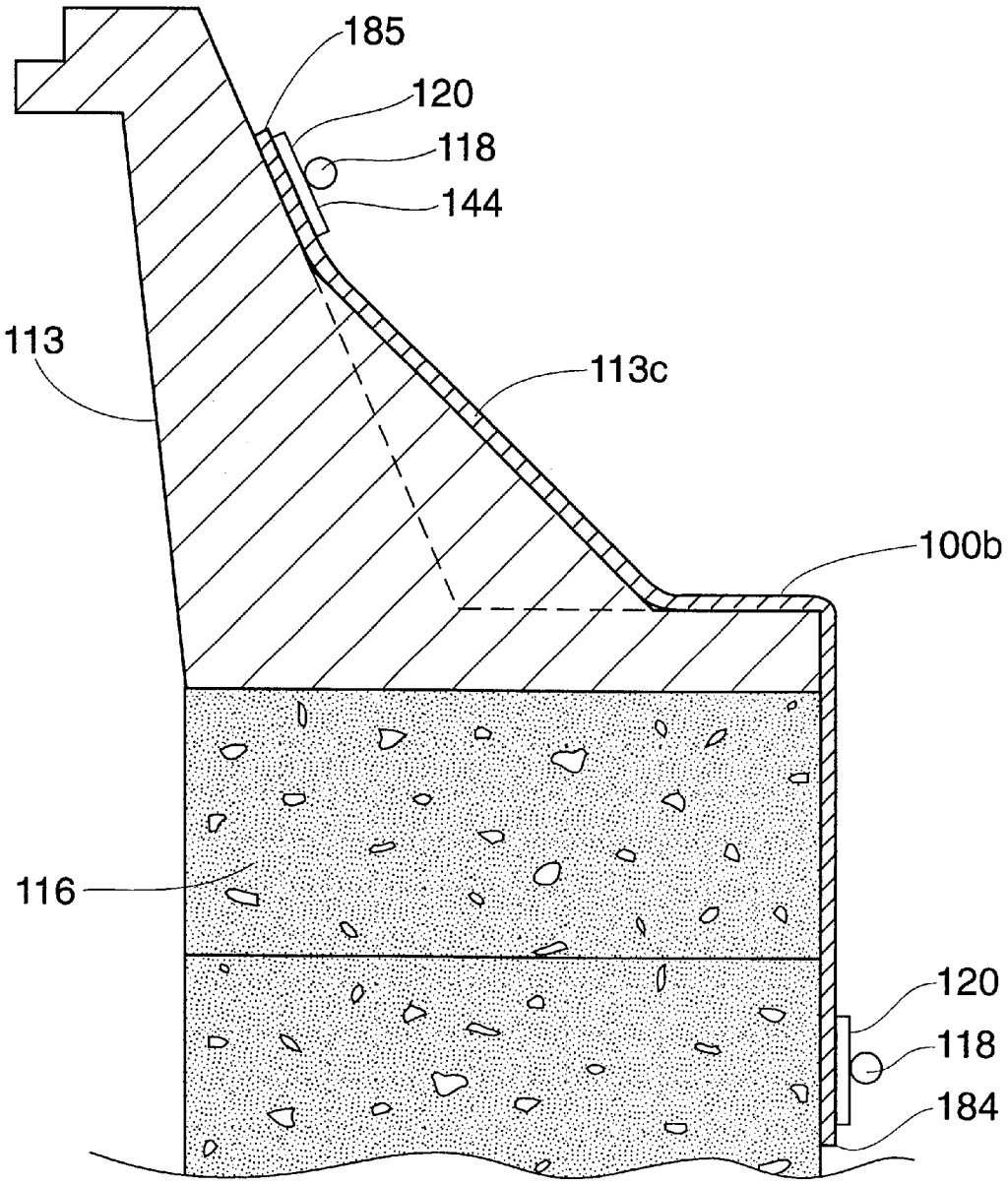
FIG. 57 discloses a sectional view of the manhole assembly, like the one shown in FIG. 45, in conjunction with a cross sectional view of an alternative external sealing structure.
Figure 59:
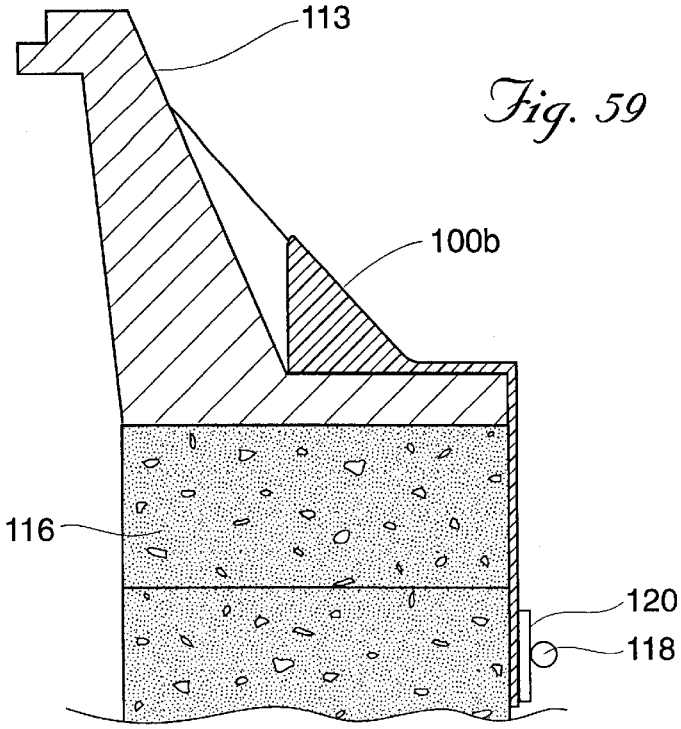
FIG. 59 discloses a cross sectional view of a portion of the manhole assembly in association with another alternative external sealing structure.
Figure 59A:
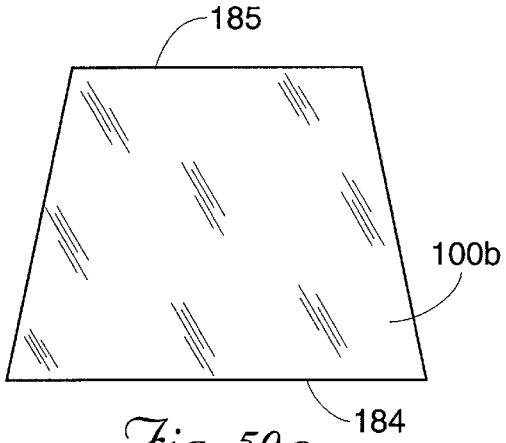
FIG. 59A is a side elevational plan view of the external sealing structure disclosed in FIG. 59 showing the tube shaped sealing structure tapering from bottom to top.
Figure 59B:
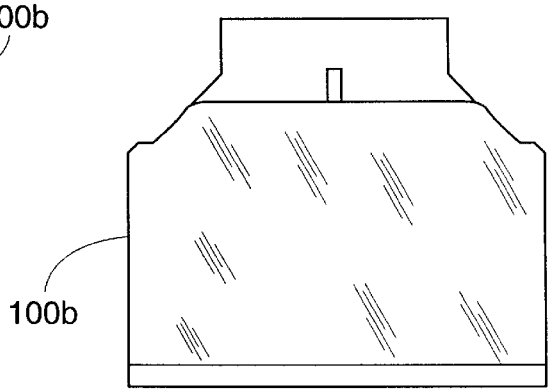
FIG. 59B is a side elevational view of the external sealing structure disclosed in FIG. 59 mounted or placed upon a manhole assembly.
Figure 60:
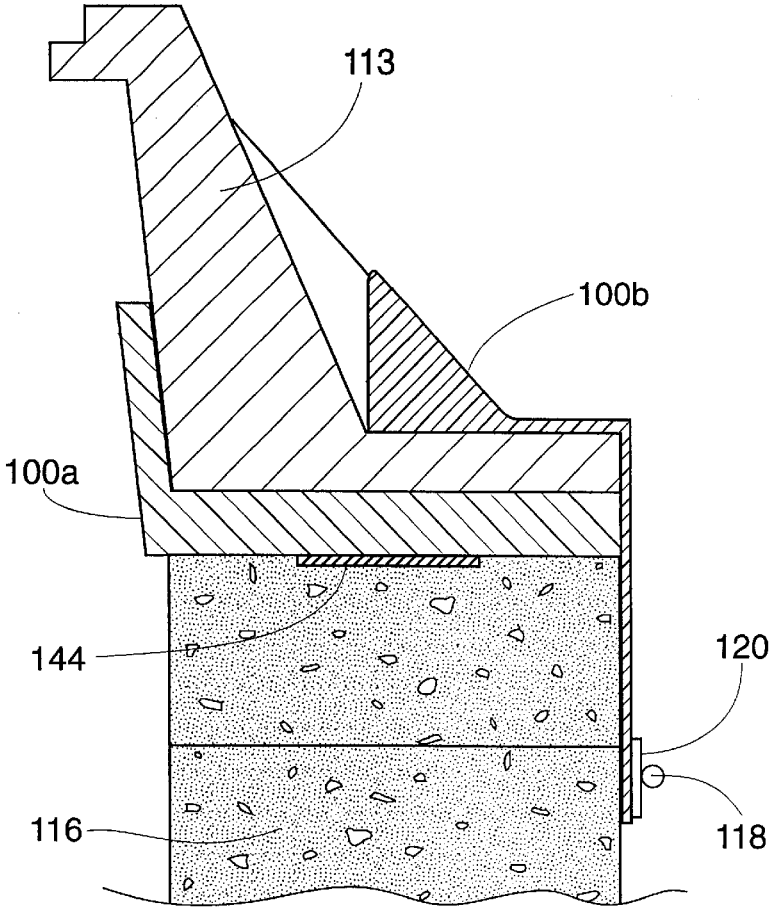
FIG. 60 a cross sectional view of a portion of the manhole assembly in association with the alternative external sealing structure of FIG. 59 and an alternative internal sealing structure.
Figure 60A:
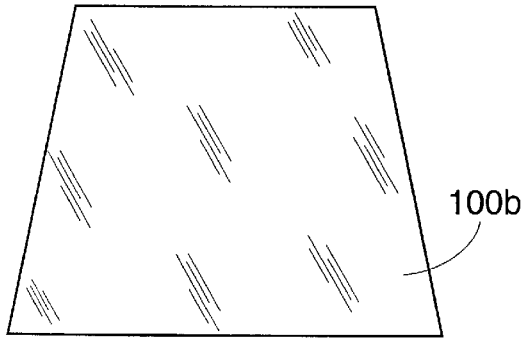
FIG. 60A is a side plan view of the external sealing structure disclosed in FIG. 60.

Referring now to FIGS. 57 and 59 through 60A another alternative external seal structure and alternatives to that structure may be seen. Referring first to FIGS. 59A and 59B the general structure of the external seal may be seen to be a tapered rubber sleeve. As illustrated by FIG. 59A the taper starts at the bottom of the sleeve and extends to the top so that the sleeve is widest at its bottom and narrowest at the top. This results in the top 185 of the sleeve folding over the surface 113A of the manhole frame when it is placed over the manhole frame 113 and adjusting rings 116. As illustrated in FIG. 57 the sleeve may be placed over the manhole frame 113 and the adjusting rings 116 to that its top extends over ribs 113C of the manhole frame 13. The top 185 and the bottom 184 may optionally be secured in place with the use a securing device like band 120 or butyl rubber 144 however the weight of the earth filled in around the manhole assembly may in and of itself be sufficient to hold the seal 100B disclosed in FIGS. 57 and 59 through 60A in place. It should be understood that the seal 100B disclosed in FIGS. 57 and 59 through 60A may be used in conjunction with any internal seal 100A disclosed herein as illustrated by the structure disclosed in FIG. 60.

Figure 61:
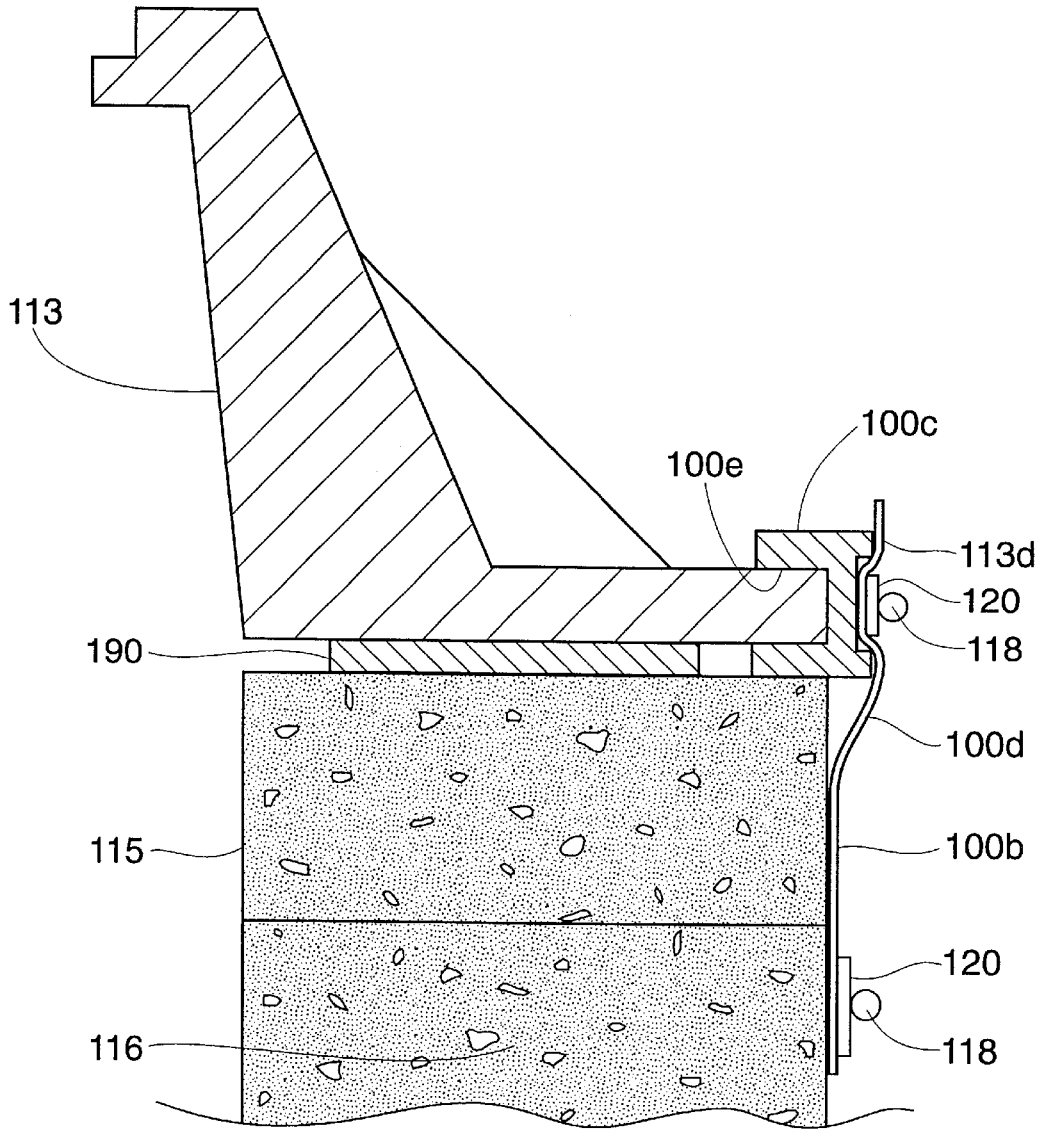
FIG. 61 is a cross sectional view showing another alternative embodiment of the external sealing structure in direct association with the manhole assembly.
Figure 61A:
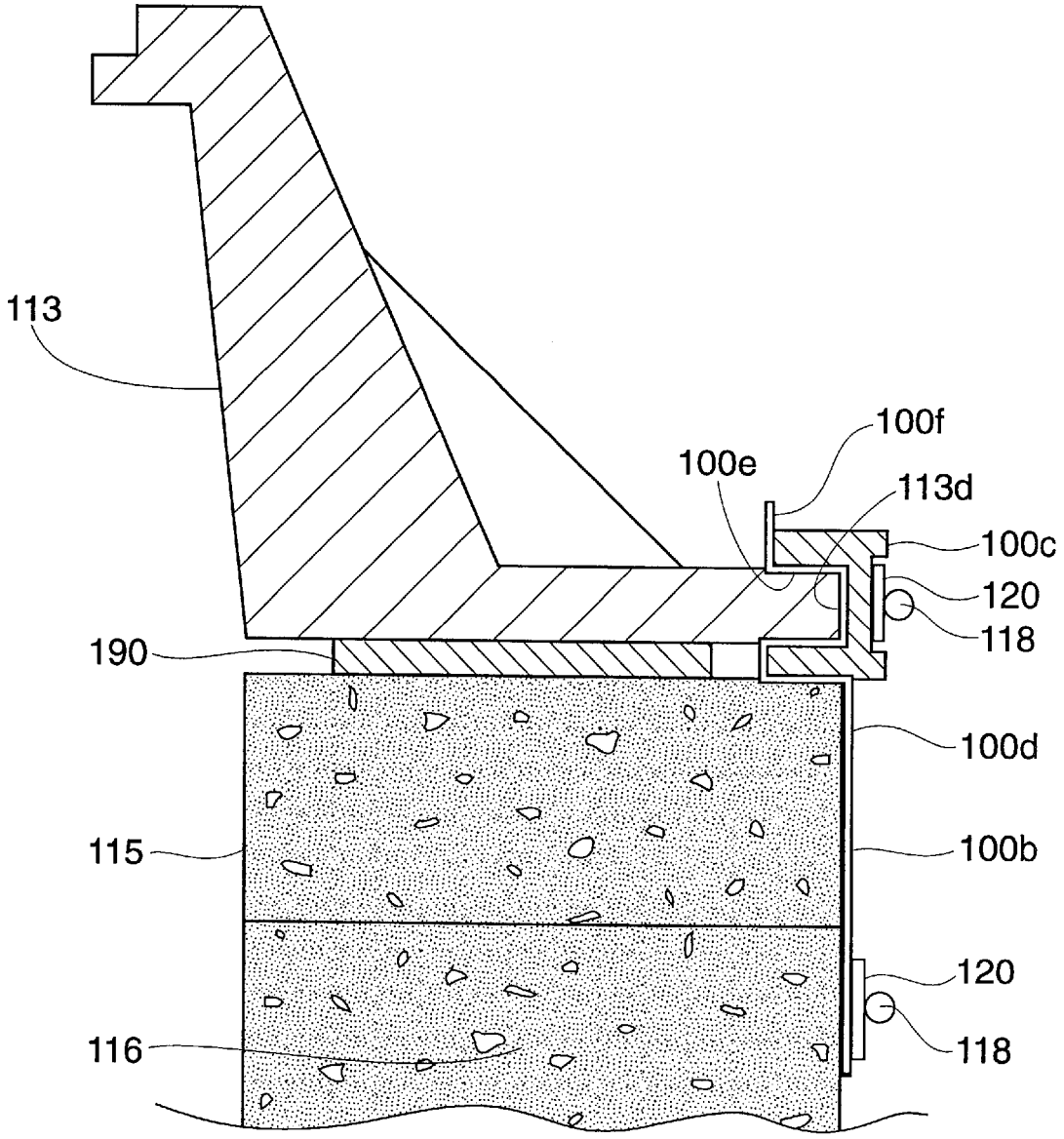
FIG. 61A is a cross sectional view showing an external sealing structure for a manhole which is an alternative to the structure disclosed in FIG. 61.

Referring now to FIGS. 61 and 61A two additional external sealing structures 100B may be seen. As illustrated in FIG. 61 the external sealing structure 100B may comprise an external rubber sheath 100D encircling the outside diameter of the manhole chimney 115. The upper end of the sheath 100D is mechanically coupled by securing band 120 (although it could be coupled by other means such as chemical bonding like epoxy bonding or through the use of butyl rubber or by any other means apparent from this disclosure to a person familiar with the present art) to a sealing ring 100C having an internal channel 100E which receives end 113D of the manhole frame 113. The lower end of the sheath 100D, as is apparent from FIG. 61 extends down over a predetermined portion of the external surface of the manhole chimney 115. In this particular embodiment this results in the external surfaces of a predetermined number concrete rings 116 being covered. A spacer 190 is used to provide additional support for the manhole frame 113 and to provide an additional seal between the manhole frame 113 and the concrete rings 116. The spacer 190 and the sealing ring 100C also help to absorb and dampen vibrations imparted to the manhole frame 113 from traffic and other sources and thereby limit the vibrations imparted to the concrete rings 116 and other structures connected to those rings 116. The lower portion of the sheath 100D is held in place mechanically by another securing band 120 although, as noted above, this is not the only means contemplated by which this may be accomplished.

Referring to FIG. 61A it may be seen that one way to vary or present an alternative to the structure disclosed in FIG. 61 is to feed the upper portion 100F of the sheath 100D through the internal channel 100E of the sealing ring 100C so that end 113D of the manhole frame 113 holds the rubber sheath end 100F in place. This makes securing band 120 for holding the upper portion 100F in place optional since the weight of the manhole frame 113 will effectively hold the end portion 100F in place.

The foregoing is considered as illustrative only of the principles of the invention. Furthermore, since numerous modifications and changes will readily occur to those skilled in the art, it is not desired to limit the invention to the exact construction and operation shown and described. While the preferred embodiment has been described, the details may be changed without departing from the invention, which is defined by the claims.

What is claimed is:

1. A liquid infiltration adapting structure for preventing liquid infiltration, the liquid infiltration adapting structure comprising:

a ring structure having at least one opening, a first side, a second side, an inner margin surface, and an outer margin surface;

at least one rectangular positioning structure coupled to said first side of said ring;

said outer margin surface includes a margin area and said at least one structure is positioned on said first side and is entirely upstanding relative to said first side and is spatially oriented so that a predetermined portion of at least one said structure extends past said margin area.

2. The liquid infiltration adapting structure of claim 1 wherein said at least one structure includes a step.

3. The liquid infiltration adapting structure of claim 1 further including a gasket structure positioned on said second side of said ring structure.

4. A liquid infiltration adapting structure for preventing liquid infiltration, the liquid infiltration adapting structure comprising:

a ring structure having at least one opening, a first side, a second side, an inner margin surface, and an outer margin surface;

at least one positioning structure coupled to said first side of said ring;

said outer margin surface includes a margin area and said at least one structure is positioned on said first side and is entirely upstanding relative to said first side and is spatially oriented so that a predetermined portion of said at least one structure extends past said margin area; and wherein said positioning structure comprises an annular extension structure integrally connected to said inner margin surface.

5. The liquid infiltration adapting structure of claim 4 wherein said annular extension structure is stepped whereby additional surface area is provided.

6. The liquid infiltration adapting structure of claim 4 further including a margin area located on said inner margin surface;

said margin area having a flange extension structure integrally mounted thereto;

said flange extension structure extending away from said first side of said ring structure.

7. The liquid infiltration adapting structure of claim 6 further including a channel located between said flange extension structure and said annular extension structure.

8. The liquid infiltration adapting structure of claim 4 wherein said annular extension structure includes an inner surface and an outer surface, and wherein at least a predetermined portion of said outer surface includes a butyl rubber compound applied thereto.

9. The liquid infiltration adapting structure of claim 4 wherein said annular extension structure includes an inner surface and an outer surface, and wherein said inner surface comprises a stepped structure.

10. A liquid infiltration adapting structure for preventing liquid infiltration, the liquid infiltration adapting structure comprising:

a generally annular tube structure having an inside surface and an outside surface;

said inside surface including an internal flange structure coupled to said inside surface and extending away from said inside surface a predetermined distance.

11. The liquid infiltration adapting structure for preventing liquid infiltration of claim 10 wherein said inside surface has a midpoint area and said internal flange structure is positioned substantially at said midpoint area.

* * * * *